US010876400B2

(12) United States Patent
Daher et al.

(10) Patent No.: US 10,876,400 B2
(45) Date of Patent: Dec. 29, 2020

(54) MINING MACHINE WITH ARTICULATING BOOM AND INDEPENDENT MATERIAL HANDLING SYSTEM

(71) Applicant: Joy Global Underground Mining LLC, Warrendale, PA (US)

(72) Inventors: Nagy Daher, Punchbowl (AU); Richard Boyd, Balgownie (AU); Edward Bagnall, Berrima (AU); Stuart Reeves, North Wollongong (AU)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

(21) Appl. No.: 15/680,637

(22) Filed: Aug. 18, 2017

(65) Prior Publication Data

US 2018/0051562 A1 Feb. 22, 2018

Related U.S. Application Data

(60) Provisional application No. 62/377,150, filed on Aug. 19, 2016, provisional application No. 62/398,834, filed on Sep. 23, 2016.

(51) Int. Cl.
*E21C 31/08* (2006.01)
*E21C 35/20* (2006.01)
(Continued)

(52) U.S. Cl.
CPC ..... *E21C 31/08* (2013.01); *E21C 27/02* (2013.01); *E21C 31/12* (2013.01); *E21C 35/20* (2013.01);
(Continued)

(58) Field of Classification Search
CPC ..... E21C 27/22; E21C 31/08; E21C 31/10
See application file for complete search history.

(56) References Cited

U.S. PATENT DOCUMENTS 1,093,787 A 4/1914 Kuhn et al.
1,735,583 A 11/1929 Morgan
(Continued)

FOREIGN PATENT DOCUMENTS

AU 466244 2/1972
CA 2141984 8/1996
(Continued)

OTHER PUBLICATIONS

International Search Report and Written Opinion for Application No. PCT/US2017/047539 dated Oct. 31, 2017 (15 pages).
(Continued)

*Primary Examiner* — Janine M Kreck
(74) *Attorney, Agent, or Firm* — Michael Best & Friedrich LLP

(57) ABSTRACT

A cutting assembly for a rock excavation machine including a frame. The cutting assembly includes a boom supported on the frame and a cutting device. In some aspects, the boom includes a first portion and a second portion, and the first portion includes a first structure and a second structure slidable relative to the first structure. The second portion includes a first member pivotably coupled to the second structure, and a second member pivotably coupled to the first member. The cutting device is supported on the second member. In some aspects, a material handling device is supported independently of the boom and movable between a retracted position and an extended position independent of the boom.

13 Claims, 24 Drawing Sheets

(51) Int. Cl.

| | |
|---|---|
| ***E21C 27/02*** | (2006.01) |
| ***E21C 31/12*** | (2006.01) |
| *E21C 25/06* | (2006.01) |
| *E21C 25/18* | (2006.01) |
| *E21C 27/12* | (2006.01) |
| *E21C 29/22* | (2006.01) |

(52) U.S. Cl.

CPC ..... *E21C 25/06* (2013.01); *E21C 25/18* (2013.01); *E21C 27/124* (2013.01); *E21C 29/22* (2013.01)

(56) References Cited

U.S. PATENT DOCUMENTS

| | | | | |
|---|---|---|---|---|
| 1,953,326 | A | 4/1934 | Morgan | |
| 2,517,267 | A | 8/1950 | Watson | |
| 2,619,338 | A | 11/1952 | Lindgren | |
| 2,619,339 | A | 11/1952 | Cartlidge | |
| 2,654,586 | A | 10/1953 | Berry | |
| 2,659,585 | A | 11/1953 | McCallum | |
| 2,745,651 | A | 5/1956 | Herrmann | |
| 2,776,823 | A | 1/1957 | Barrett | |
| 3,157,437 | A | 11/1964 | Gonski | |
| 3,197,256 | A | 7/1965 | Hlinsky | |
| 3,302,974 | A | 2/1967 | Hlinsky | |
| 3,353,871 | A | 11/1967 | Arentzen | |
| 3,412,816 | A | 11/1968 | Lautsch | |
| 3,446,535 | A | 5/1969 | Lauber | |
| 3,647,263 | A | 3/1972 | Lauber et al. | |
| 3,663,054 | A | 5/1972 | Dubois | |
| 3,719,404 | A | 3/1973 | Sterner | |
| 3,729,056 | A | 4/1973 | Paurat | |
| 3,840,271 | A | 10/1974 | Sugden | |
| 3,922,017 | A | 11/1975 | Cobb | |
| 3,929,378 | A | 12/1975 | Frenyo et al. | |
| 3,972,571 | A | 8/1976 | Benkowski | |
| 3,995,907 | A | 12/1976 | Dubois | |
| 4,005,905 | A | 2/1977 | Dubois | |
| 4,087,131 | A | 5/1978 | Peterson et al. | |
| 4,108,494 | A | 8/1978 | Kogler | |
| 4,230,372 | A * | 10/1980 | Marten | E02F 3/188 173/195 |
| 4,248,481 | A | 2/1981 | Stoltefuss | |
| 4,273,383 | A | 6/1981 | Grisebach | |
| 4,302,054 | A | 11/1981 | Haskew et al. | |
| 4,377,311 | A | 3/1983 | Seller | |
| 4,470,635 | A * | 9/1984 | Paurat | E21D 9/102 173/4 |
| 4,516,807 | A | 5/1985 | Eagles | |
| 4,548,442 | A | 10/1985 | Sugden et al. | |
| 4,589,701 | A * | 5/1986 | Beckmann | E21C 27/22 299/64 |
| 4,643,483 | A | 2/1987 | Brooks et al. | |
| 4,647,112 | A | 3/1987 | Demoulin et al. | |
| 4,662,684 | A | 5/1987 | Marten | |
| 4,682,819 | A | 7/1987 | Masse | |
| 4,755,002 | A | 7/1988 | Parrott | |
| 4,760,513 | A | 7/1988 | Edwards | |
| 4,796,713 | A | 1/1989 | Bechem | |
| 4,838,614 | A | 6/1989 | Pentith et al. | |
| 4,838,615 | A | 6/1989 | Oldham | |
| 5,028,092 | A | 7/1991 | Coski | |
| 5,087,102 | A | 2/1992 | Kiefer | |
| 5,190,353 | A | 3/1993 | Bechem | |
| 5,205,612 | A | 4/1993 | Sugden et al. | |
| 5,210,997 | A | 5/1993 | Mountcastle, Jr. | |
| 5,234,257 | A | 8/1993 | Sugden et al. | |
| 5,601,153 | A | 2/1997 | Ensminger et al. | |
| 5,676,125 | A * | 10/1997 | Kelly | B28D 1/045 125/13.03 |
| 5,697,733 | A | 12/1997 | Marsh | |
| 5,938,288 | A | 8/1999 | Saint-Pierre et al. | |
| 6,086,257 | A | 7/2000 | Lee | |
| 6,561,590 | B2 | 5/2003 | Sugden | |
| 6,857,706 | B2 | 2/2005 | Hames et al. | |
| 7,182,407 | B1 * | 2/2007 | Peach | E21C 25/16 299/75 |
| 7,325,882 | B2 | 2/2008 | Sugden et al. | |
| 7,384,104 | B2 | 6/2008 | Sugden | |
| 7,431,402 | B2 | 10/2008 | Peach et al. | |
| 7,490,911 | B2 | 2/2009 | Steinberg et al. | |
| 7,695,071 | B2 | 4/2010 | Jackson et al. | |
| 7,934,776 | B2 | 5/2011 | de Andrade et al. | |
| 8,079,647 | B2 | 12/2011 | Yao et al. | |
| 8,328,292 | B2 | 12/2012 | de Andrade et al. | |
| 8,636,324 | B2 | 1/2014 | Skea | |
| 8,727,450 | B2 | 5/2014 | de Andrade et al. | |
| 9,470,087 | B2 | 10/2016 | Smith et al. | |
| 2002/0093239 | A1 | 7/2002 | Sugden | |
| 2005/0200192 | A1 | 9/2005 | Sugden et al. | |
| 2007/0090678 | A1 | 4/2007 | Peach et al. | |
| 2007/0193810 | A1 | 8/2007 | Steinberg et al. | |
| 2008/0156531 | A1 | 7/2008 | Boone et al. | |
| 2009/0058172 | A1 | 3/2009 | DeAndrade et al. | |
| 2009/0066148 | A1 | 3/2009 | Willison | |
| 2009/0127918 | A1 | 5/2009 | Yao et al. | |
| 2010/0260563 | A1 | 10/2010 | Conroy et al. | |
| 2011/0062768 | A1 | 3/2011 | Van Zyl et al. | |
| 2011/0181097 | A1 | 7/2011 | Skea | |
| 2012/0098325 | A1 | 4/2012 | Junker et al. | |
| 2013/0057044 | A1 | 3/2013 | De Andrade et al. | |
| 2014/0077578 | A1 * | 3/2014 | Smith | E21C 25/06 299/1.4 |
| 2014/0091612 | A1 | 4/2014 | Rowher et al. | |
| 2015/0152728 | A1 | 6/2015 | Hartwig et al. | |

FOREIGN PATENT DOCUMENTS

| | | | |
|---|---|---|---|
| CL | 35975 | | 9/1987 |
| CL | 200901978 | | 2/2010 |
| CN | 101778998 | A | 7/2010 |
| CN | 101828004 | A | 9/2010 |
| CN | 102061914 | A | 5/2011 |
| CN | 102305067 | A | 1/2012 |
| CN | 102587911 | | 7/2012 |
| CN | 102606154 | A | 7/2012 |
| CN | 10204927 | | 10/2012 |
| CN | 102733803 | | 10/2012 |
| CN | 202500560 | U | 10/2012 |
| CN | 202991028 | U | 6/2013 |
| CN | 103206213 | A | 7/2013 |
| CN | 103498671 | A | 1/2014 |
| CN | 104047603 | A | 9/2014 |
| CN | 104500086 | A | 4/2015 |
| CN | 204283458 | U | 4/2015 |
| DE | 4123307 | C1 | 12/1992 |
| DE | 4440261 | | 5/1996 |
| DE | 19900906 | A1 | 7/2000 |
| EP | 0176234 | A1 | 4/1986 |
| EP | 0329915 | A1 | 8/1989 |
| GB | 2214963 | A | 9/1989 |
| JP | S5540058 | U | 3/1980 |
| JP | H02147793 | A | 6/1990 |
| RU | 2142561 | C1 | 12/1999 |
| RU | 2187640 | C1 | 8/2002 |
| RU | 2209979 | C2 | 8/2003 |
| RU | 2276728 | C1 | 5/2006 |
| RU | 2441155 | C1 | 1/2012 |
| SU | 323552 | A | 11/1972 |
| SU | 581263 | | 11/1977 |
| SU | 619117 | | 8/1978 |
| SU | 750061 | | 7/1980 |
| SU | 962626 | | 9/1982 |
| SU | 1328521 | | 8/1987 |
| SU | 1712599 | A1 | 2/1992 |
| SU | 1731946 | | 5/1992 |
| SU | 1744249 | A1 | 6/1992 |
| WO | WO0043637 | | 7/2000 |
| WO | WO0046486 | | 8/2000 |
| WO | WO0201045 | | 1/2002 |
| WO | WO02066793 | | 8/2002 |
| WO | 2003062587 | | 7/2003 |

(56) References Cited

FOREIGN PATENT DOCUMENTS

| | | | |
|---|---|---|---|
| WO | WO03089761 | | 10/2003 |
| WO | 2012156843 | A2 | 9/2005 |
| WO | 2006075910 | A1 | 7/2006 |

OTHER PUBLICATIONS

International Mining, "DynaCut Technology Achieving Breakthroughs," <https://im-mining.com/2015/12/17/dynacut-technology-achieving-breakthroughs/> web page accessed Nov. 22, 2019.
Mining3 Mining, "CRCMining Joy Global Oscillating Disc Cutter (ODC) Hard Rock Cutting Machine," <https://www.youtube.com/watch?v=anyPQWkH4rM> web page accessed Oct. 24, 2019.
Chilean Patent Office Search Report and Examiner's Report for Application No. 201900449 dated Mar. 10, 2020 (20 pages including statement of relevance).
Chinese Patent Office Action for Application No. 201780062508.6 dated Jun. 2, 2020 (12 pages including English summary).
Extended European Search Report issued by the European Patent Office for Application No. 17842188.9 dated Aug. 13, 2020 (13 pages).
Chilean Patent Office Search Report and Examiner's Response for Application No. 201900449 dated Sep. 10, 2020 (19 pages including statement of relevance).

* cited by examiner

MINING MACHINE WITH ARTICULATING BOOM AND INDEPENDENT MATERIAL HANDLING SYSTEM

CROSS-REFERENCE TO RELATED APPLICATION

This application claims the benefit of prior-filed U.S. Provisional Patent Application No. 62/377,150, filed Aug. 19, 2016, and U.S. Provisional Patent Application No. 62/398,834, filed Sep. 23, 2016. The entire contents of these documents are incorporated by reference herein.

BACKGROUND

The present disclosure relates to mining and excavation machines, and in particular to a cutting device for a mining or excavation machine.

Hard rock mining and excavation typically requires imparting large energy on a portion of a rock face in order to induce fracturing of the rock. One conventional technique includes operating a cutting head having multiple mining picks. Due to the hardness of the rock, the picks must be replaced frequently, resulting in extensive down time of the machine and mining operation. Another technique includes drilling multiple holes into a rock face, inserting explosive devices into the holes, and detonating the devices. The explosive forces fracture the rock, and the rock remains are then removed and the rock face is prepared for another drilling operation. This technique is time-consuming and exposes operators to significant risk of injury due to the use of explosives and the weakening of the surrounding rock structure. Yet another technique utilizes roller cutting element(s) that rolls or rotates about an axis that is parallel to the rock face, imparting large forces onto the rock to cause fracturing.

SUMMARY

In one aspect, a cutting assembly for a rock excavation machine having a frame includes a boom supported on the frame and a cutting device. The boom includes a first portion and a second portion. The first portion includes a first structure and a second structure slidable relative to the first structure. The second portion includes a first member pivotably coupled to the second structure, and a second member pivotably coupled to the first member. The cutting device is supported on the second member.

In another aspect, a cutting assembly for a rock excavation machine having a frame includes a boom and a cutting device. The boom includes a first end supported on the frame and a second end. The boom further includes a first portion adjacent the first end and a second portion adjacent the second end. The second portion is supported for movement relative to the first end by a telescopic coupling and is pivotable relative to the first portion about an axis. The cutting device is supported on the second end of the boom.

In yet another aspect, a rock excavation machine includes a chassis, a boom supported on the chassis, a cutting device supported on the boom, and a material handling device supported on the chassis independently of the boom. At least a portion of the boom is movable relative to the chassis between a retracted position and an extended position. The material handling device is movable relative to the chassis between a retracted position and an extended position independent of the boom.

Other aspects will become apparent by consideration of the detailed description and accompanying drawings.

Figure 1:
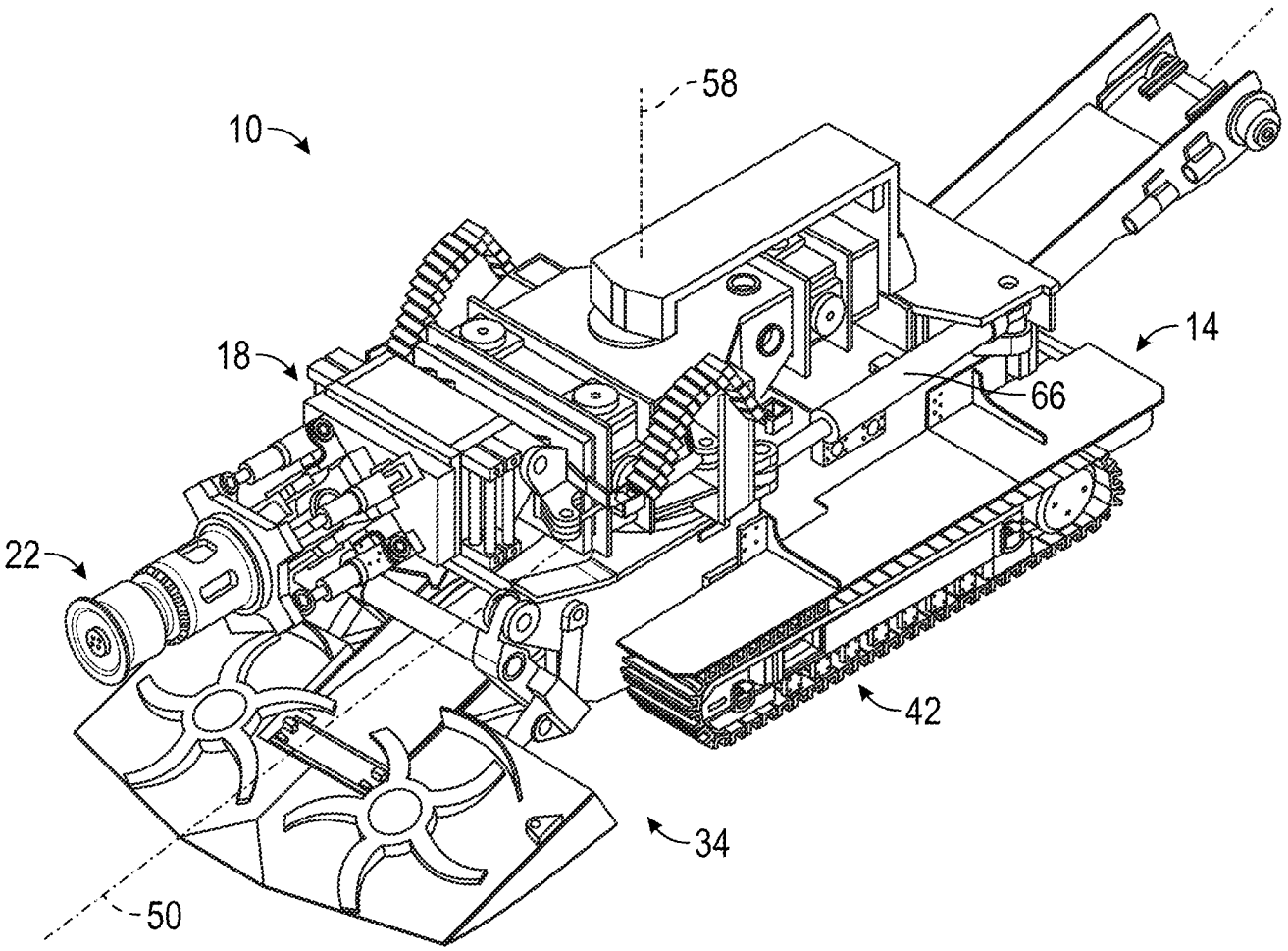
FIG. 1 is a perspective view of a mining machine.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or fluid connections or couplings, whether direct or indirect. Also, electronic communications and notifications may be performed using any known means including direct connections, wireless connections, etc.

DETAILED DESCRIPTION

FIGS. 1-4 illustrate a mining machine 10 (e.g., an entry development machine) including a chassis 14, a boom 18, a cutter head 22 for engaging a rock face 30 (FIG. 18), and a material handling system 34. In the illustrated embodiment, the chassis 14 is supported on a crawler mechanism 42 for movement relative to a floor (not shown). The chassis 14 includes a first or forward end and a second or rear end, and a longitudinal chassis axis 50 extends between the forward end and the rear end. The boom 18 is supported on the chassis 14 by a turntable or swivel joint 54. The swivel joint 54 (FIG. 2) is rotatable about a swivel axis 58 that is perpendicular to the chassis axis 50 (e.g., a vertical axis perpendicular to the support surface) to pivot the boom 18 in a plane that is generally parallel the chassis axis 50 (e.g., a horizontal plane parallel to the support surface). In the illustrated embodiment, the chassis 14 includes slew actuators or cylinders 66 for pivoting the swivel joint 54 and the boom 18 laterally about the swivel axis 58.

Figure 2:
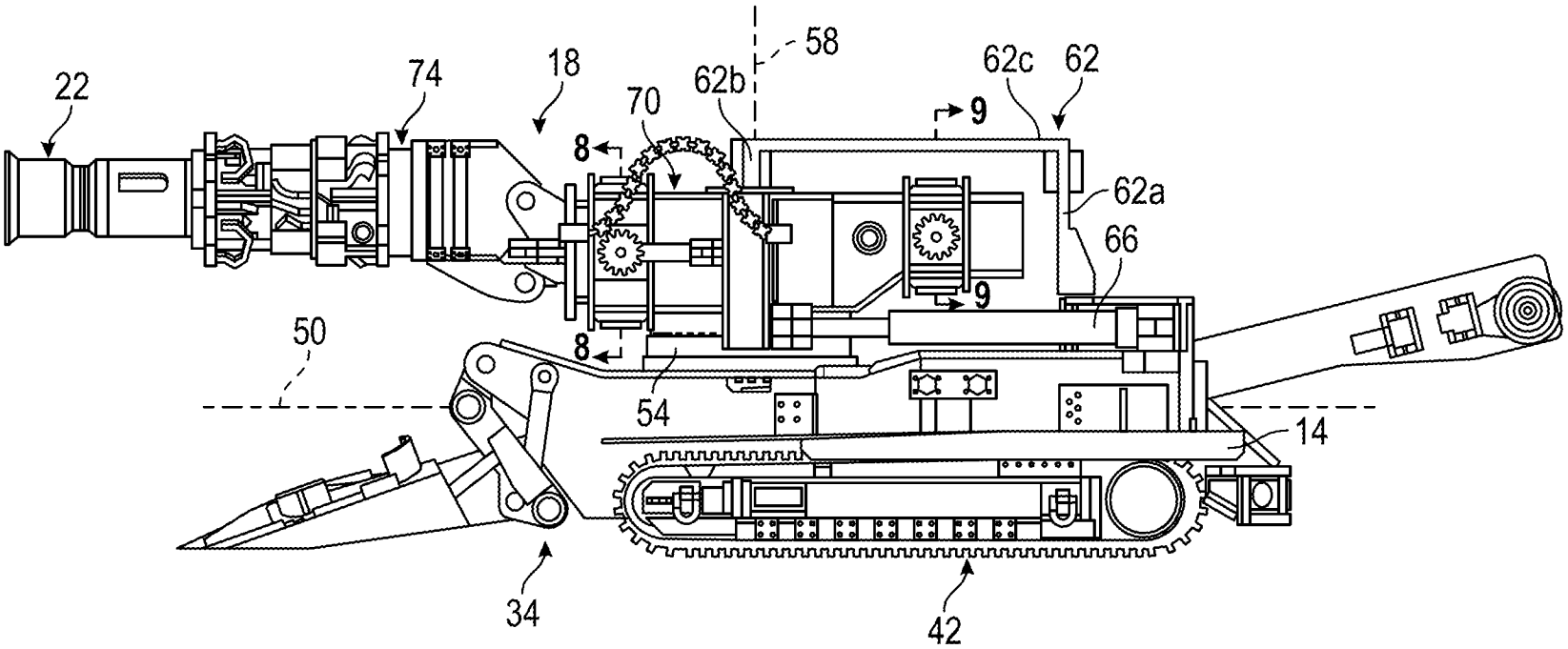
FIG. 2 is side view of the mining machine of FIG. 1.
Figure 3:
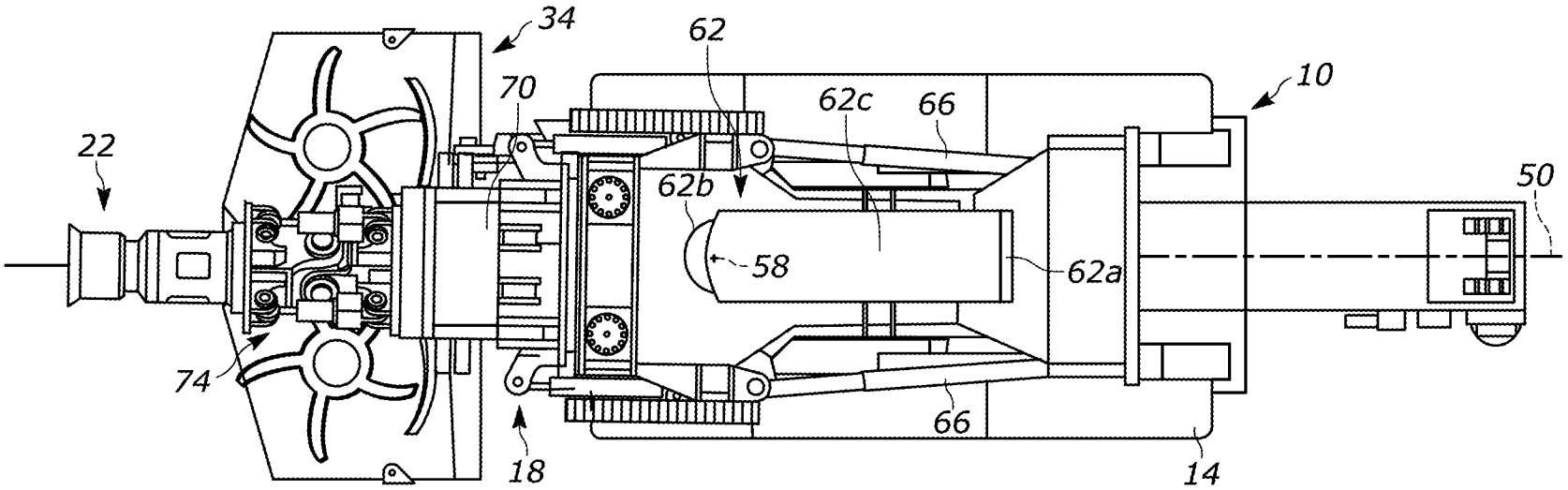
FIG. 3 is a top view of the mining machine of FIG. 1.
Figure 4:
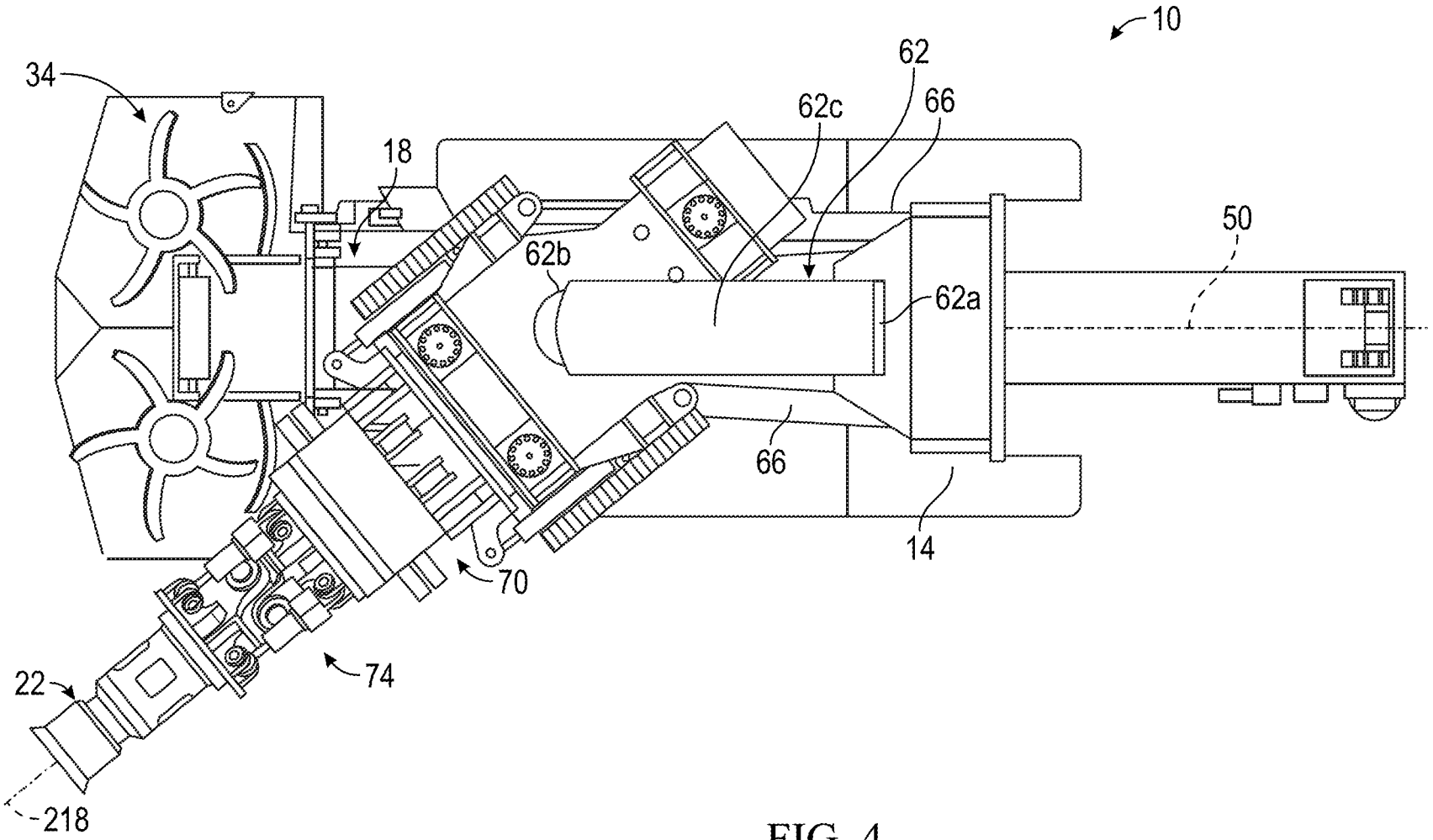
FIG. 4 is a top view of the mining machine of FIG. 1 with a boom in a pivoted position.

As shown in FIGS. 2-4, the machine 10 also includes a service support member or bridge 68 extending between the chassis 10 and the boom 18. In the illustrated embodiment, the bridge 68 includes a first portion 68*a* coupled to the chassis 14, a second portion 68*b* coupled to the boom 18, and an intermediate portion 68*c* coupled between the first portion 68*a* and the second portion 68*c*. The second portion 68*b* is substantially aligned with the swivel axis 58 but does not rotate with the boom 18. In some embodiments, a bearing (not shown) permits sliding movement between the second portion 68*b* and the boom 18. The intermediate portion 68*c* may be rigidly secured at each end to the first portion 68*a* and second portion 68*b*, respectively, or a coupling (e.g., a spherical joint) may permit some relative movement. The bridge 68 supports and/or guides various service lines (e.g., conduits, cables, wires, hoses, and pipes—not shown) between the chassis 14 and the boom 18. The service lines may include electrical slip rings, rotary unions, or manifolds at connection points.

Figure 6:
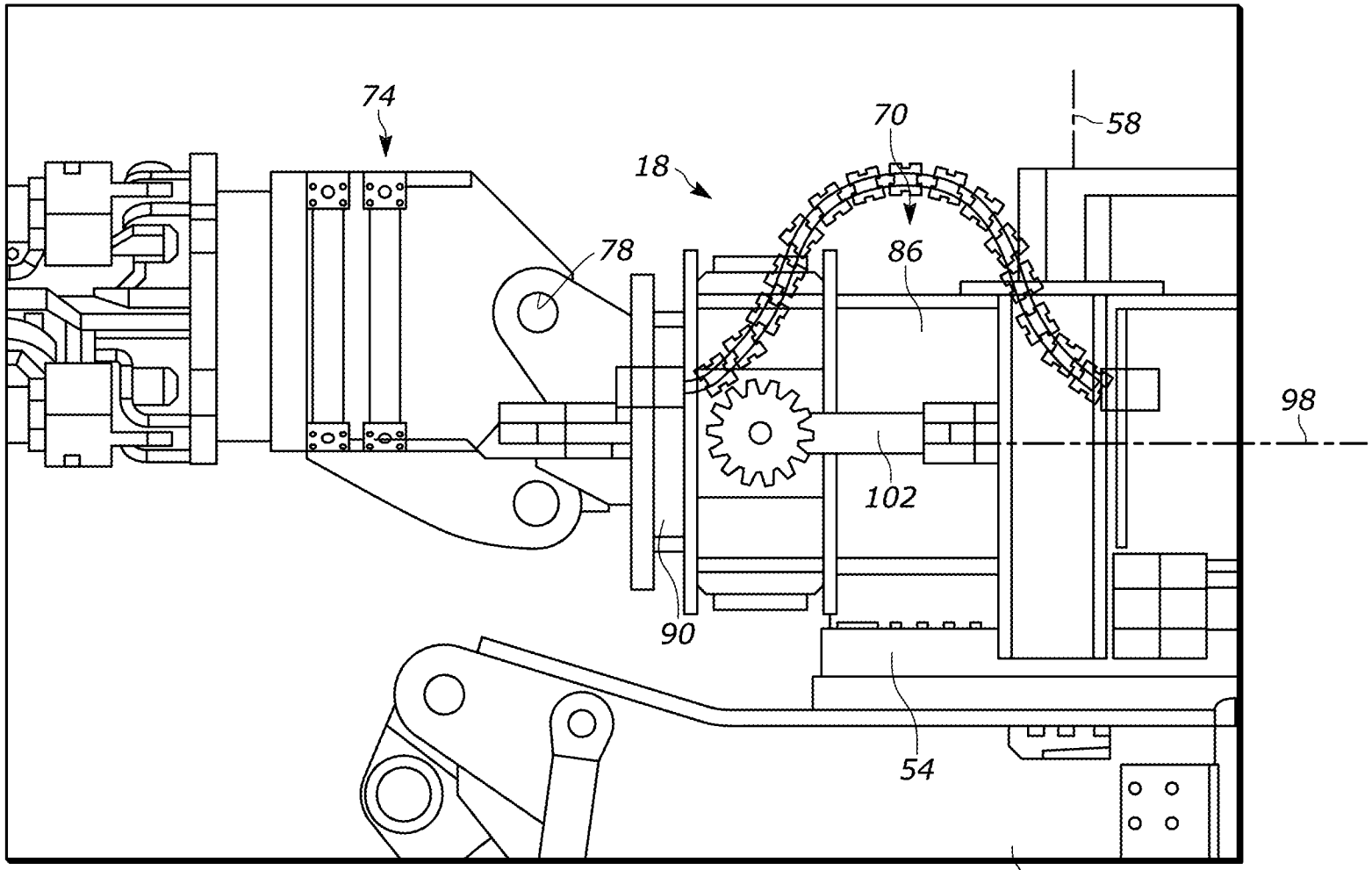
FIG. 6 is a side view of a portion of the boom in a retracted position.
Figure 7:
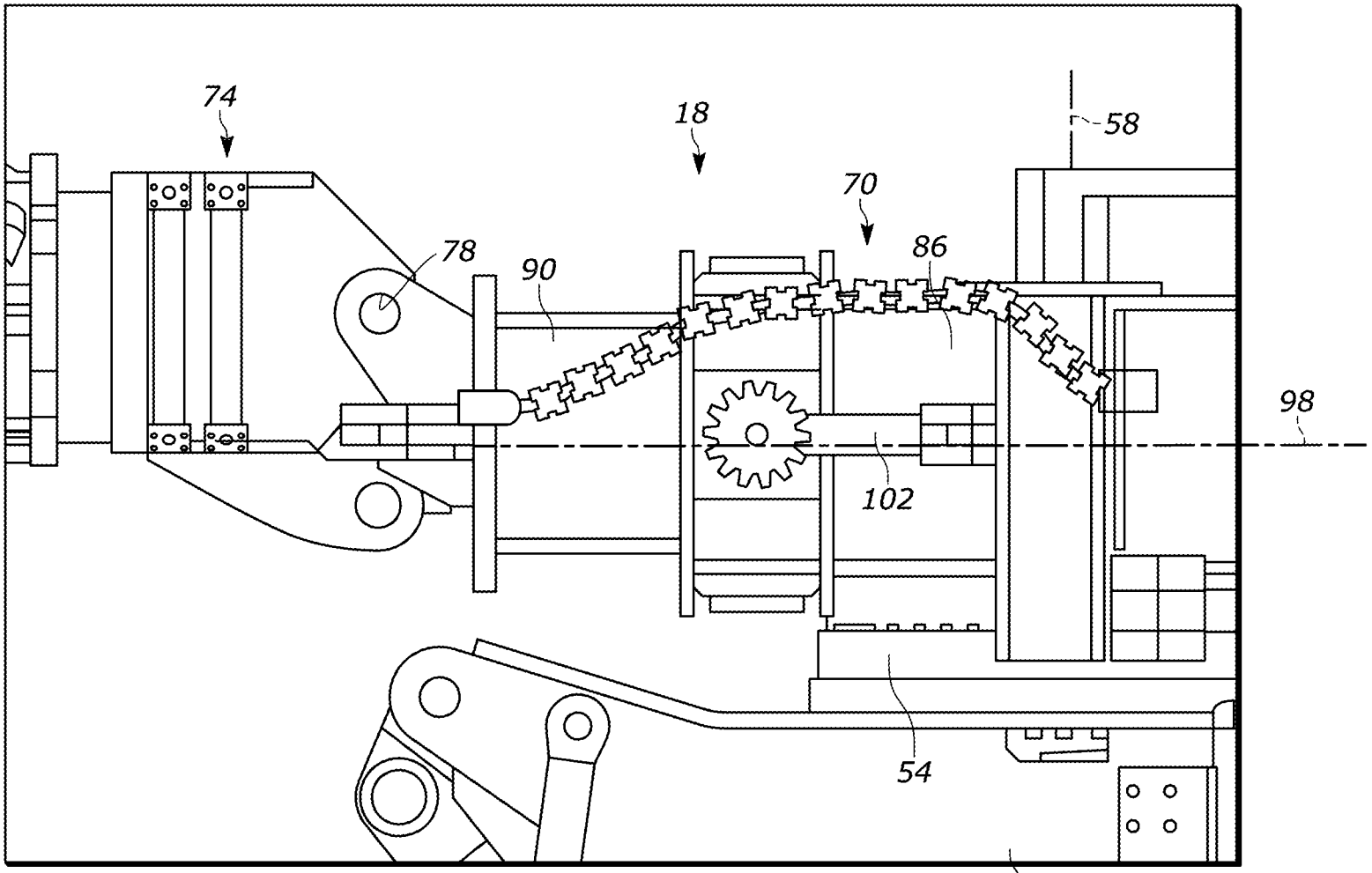
FIG. 7 is a side view of a portion of the boom in an extended position.

As shown in FIG. 2, the boom 18 includes a first portion or base portion 70 and a second portion or wrist portion 74 supporting the cutter head 22. Referring to FIGS. 6 and 7, in the illustrated embodiment, the wrist portion 74 is pivotably coupled to the base portion 70 by a pin joint 78. The base portion 70 includes a first or stationary structure 86 secured to the swivel joint 54 and a second or movable structure 90. The stationary structure 86 is pivotable with the swivel joint 54 and includes an opening 94 (FIG. 8) receiving the movable structure 90. The movable structure 90 is movable relative to the stationary structure 86 in a telescoping manner along a base axis 98. Linear actuators or slide actuators 102 (e.g., fluid cylinders) may be coupled between the stationary structure 86 and the movable structure 90 to move the movable structure 90 between a retracted position (FIG. 6) and an extended position (FIG. 7). The slide actuators 102 may be coupled to the exterior surfaces of the stationary structure 86 and the movable structure 90. In some embodiments, a sensor (e.g., a transducer—not shown) measures the stroke or position of the slide actuators 102.

Figure 8:
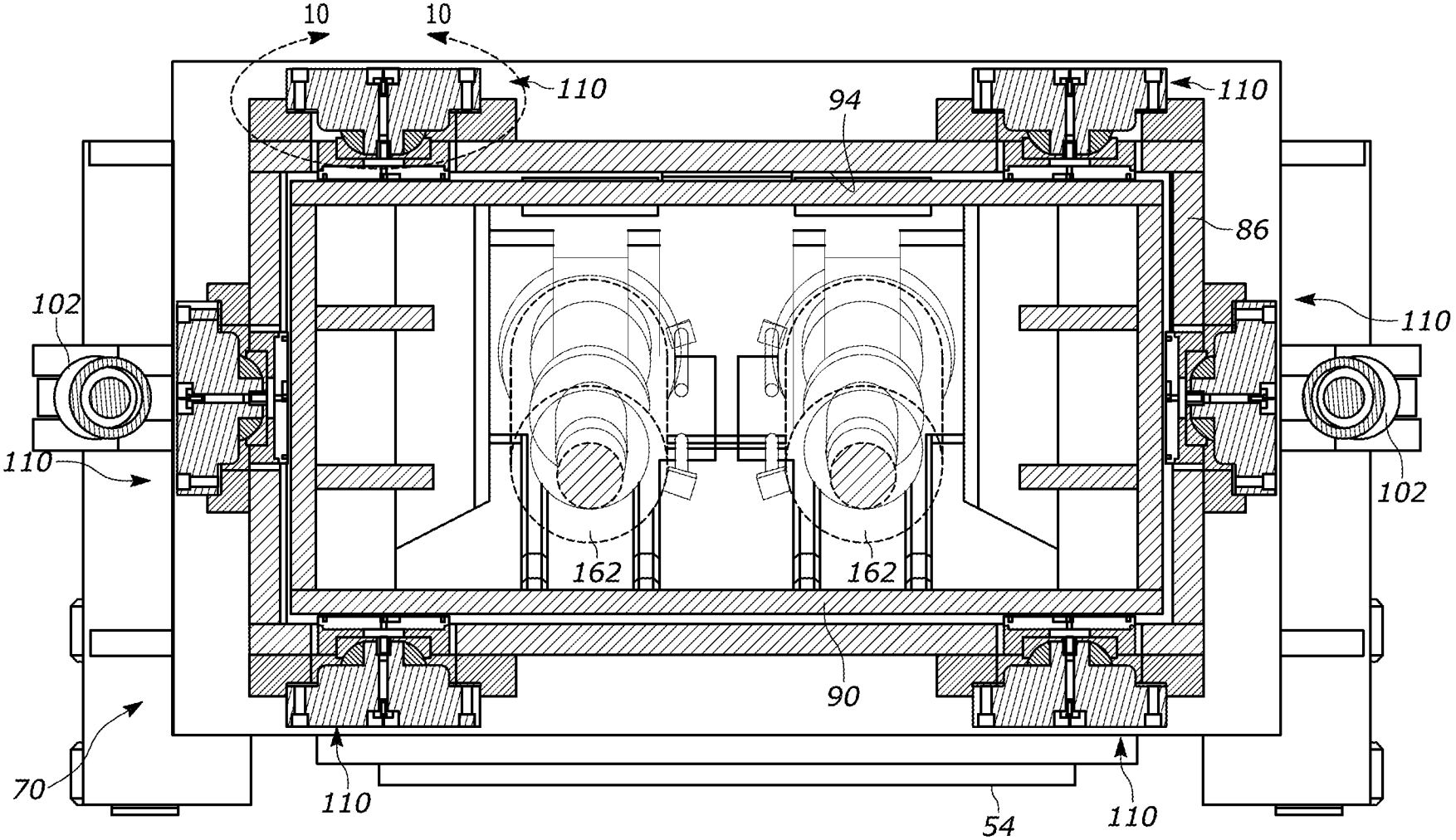
FIG. 8 is a cross-section view of a portion of the boom of FIG. 2, viewed along section 8-8.

As shown in FIG. 8, the movable structure 90 is supported relative to the stationary structure 86 by bearing assemblies 110. In the illustrated embodiment, six bearing assemblies 110 are located in a common plane normal to the base axis 98, with two bearing assemblies 110 abutting the upper and lower surfaces of the movable structure 90 and one bearing assembly 110 abutting each lateral surface of the movable structure 90.

Figure 9:
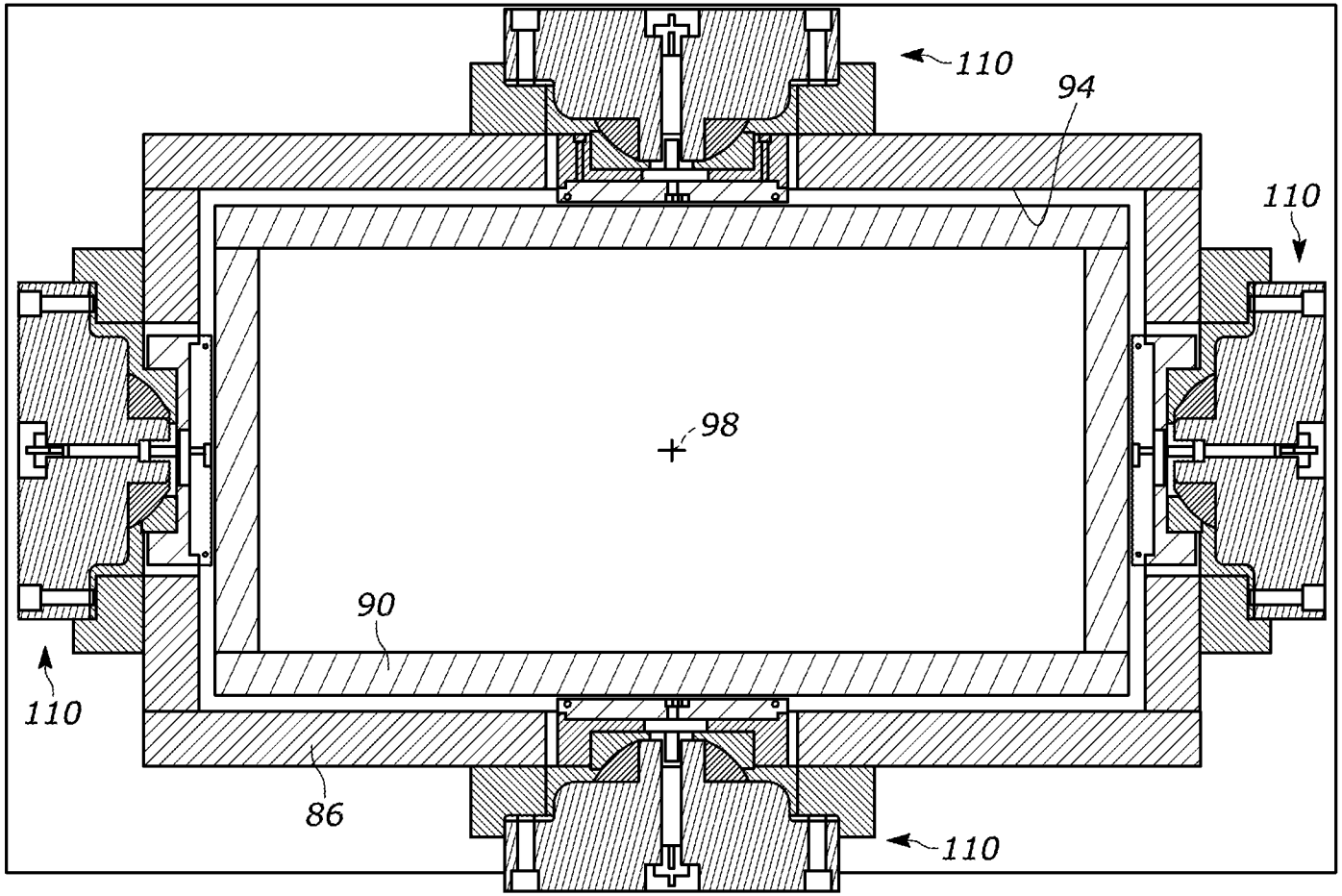
FIG. 9 is a cross-section view of a portion of the boom of FIG. 2, viewed along section 9-9.

As shown in FIG. 9, an additional set of bearing assemblies 110 may be positioned in a second plane normal to the base axis 98 and axially offset from the plane illustrated in FIG. 8. In the illustrated embodiment, the second set includes four bearing assemblies 110, with one bearing assembly 110 abutting each surface of the movable structure 90. In other embodiments, the base portion 70 may include fewer or more bearing assemblies 110, and the bearing assemblies 110 may be positioned in additional planes along the length of the base axis 98. The bearing assemblies 110 may be positioned in a different manner. In the illustrated embodiment, the bearing assemblies 110 are accessible from an outer surface of the boom 18; in other embodiments, the bearing assemblies 110 may be accessible only from an interior portion of the boom 18.

Figure 10:
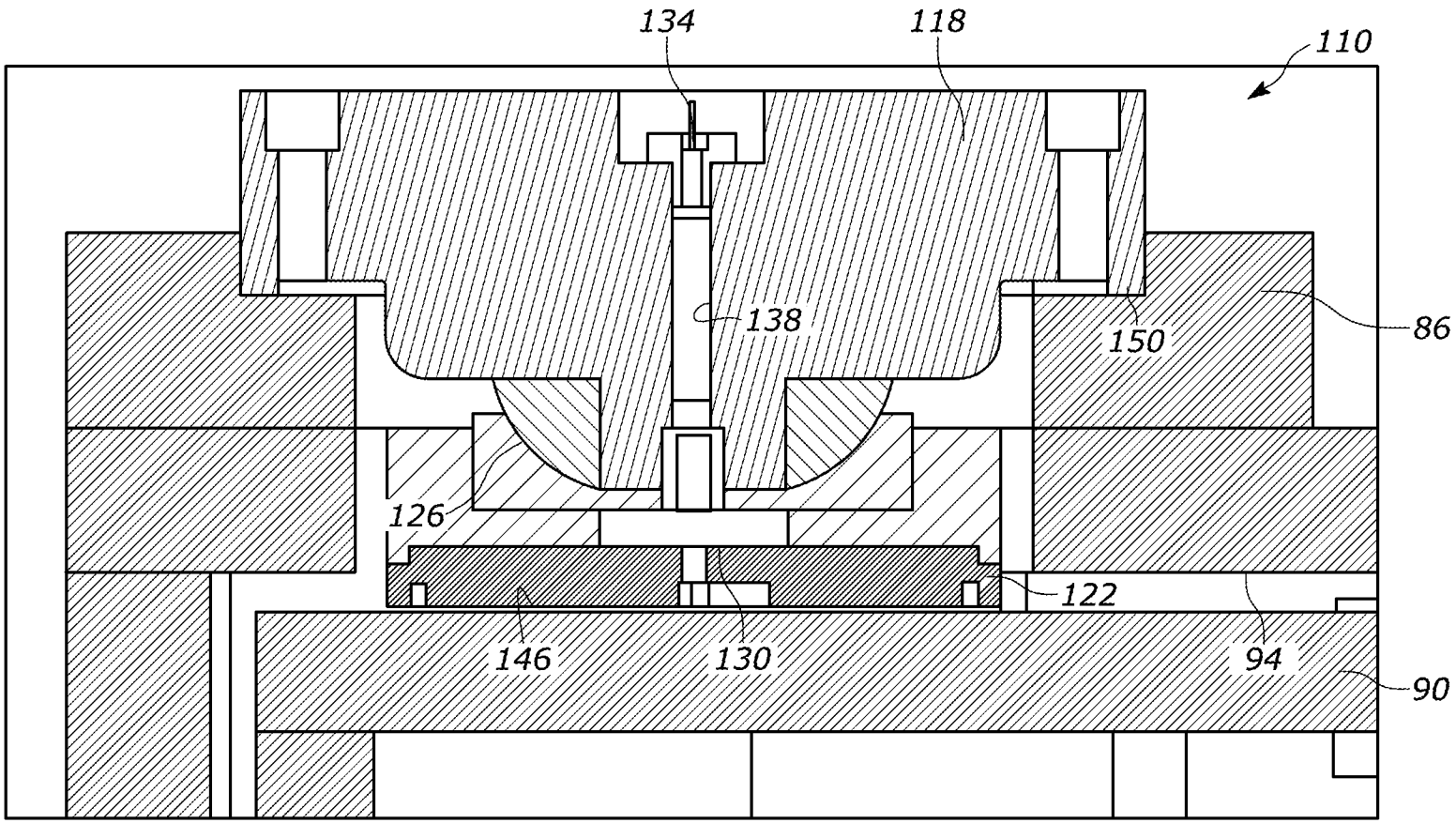
FIG. 10 is an enlarged view of portion 10-10 of the cross-section view of FIG. 8.

As shown in FIG. 10, each bearing assembly 110 includes a main support 118 secured to the base portion 70 and a pad 122 abutting a surface of the movable structure 90. In addition, a spherical bearing member 126 is coupled to the main support 118 to permit pivoting movement of the pad 122 relative to the main support 118. The pad 122 includes one or more pockets or chambers or galleries 130 formed in a surface of the pad 122 adjacent the movable structure 90. The main support 118 includes a port 134 and a passage 138 providing communication between the port 134 and galleries 130. The port 134 may receive a lubricant (e.g. grease) through a manual feed or an automatic lubrication system, and the lubricant may be transferred to the galleries 130 to lubricate the interface between the pad 122 and the movable structure 90. In addition, in the illustrated embodiment, a hard, low-friction bearing surface 146 is secured to an outer surface of the movable structure 90. The bearing surface 146 may be removably secured to the movable structure 90 (e.g., by fasteners) or attached by fusion (e.g., welding). The bearing assemblies 110 provide a low-friction interface and are capable of transmitting large forces caused by the cutting operation.

In addition, a shim pack 150 may be positioned between the main support 118 and the stationary structure 86 to adjust the position of the main support 118. A spring pack (not shown) may be positioned between the main support 118 and the spherical bearing member 126 to provide an initial load or preload to ensure that the pad 122 maintains positive contact with the movable structure 90 during operation. In other embodiments, other types of bearing assemblies may be used.

Figure 11:
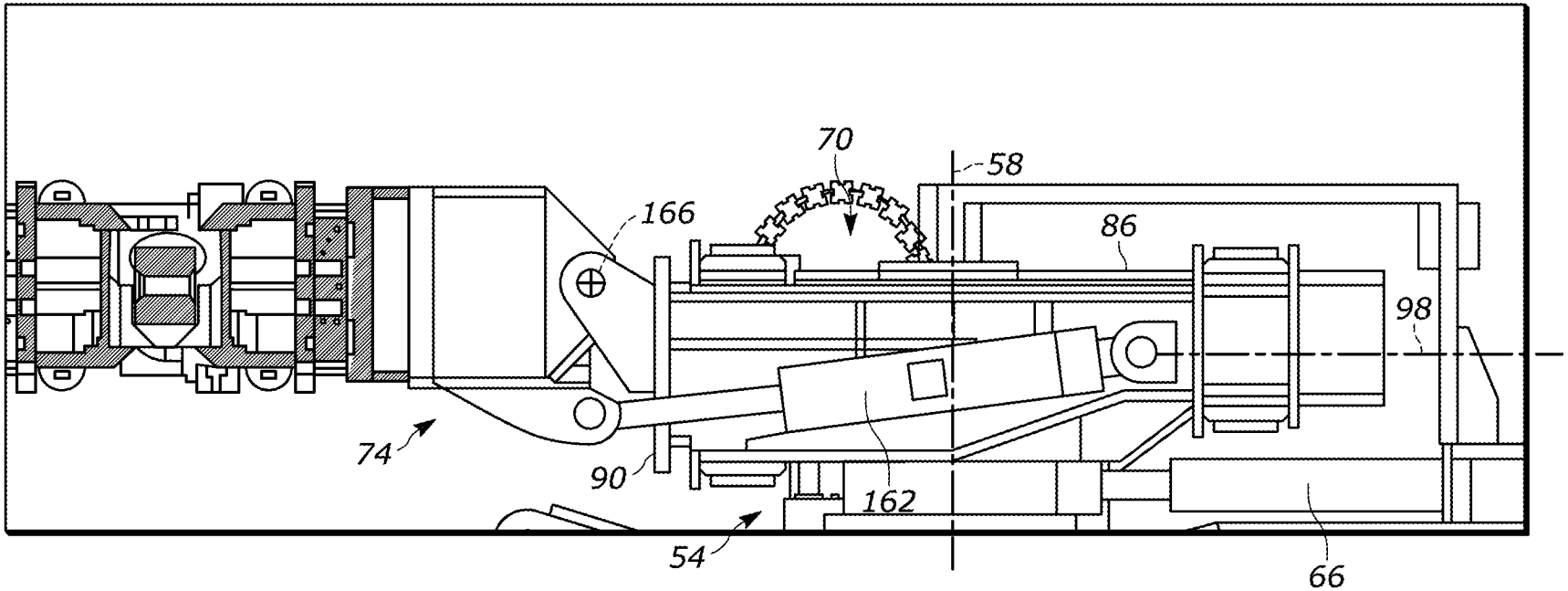
FIG. 11 is a cross-section view of a portion of the mining machine of FIG. 5, viewed along section 11-11.
Figure 12:
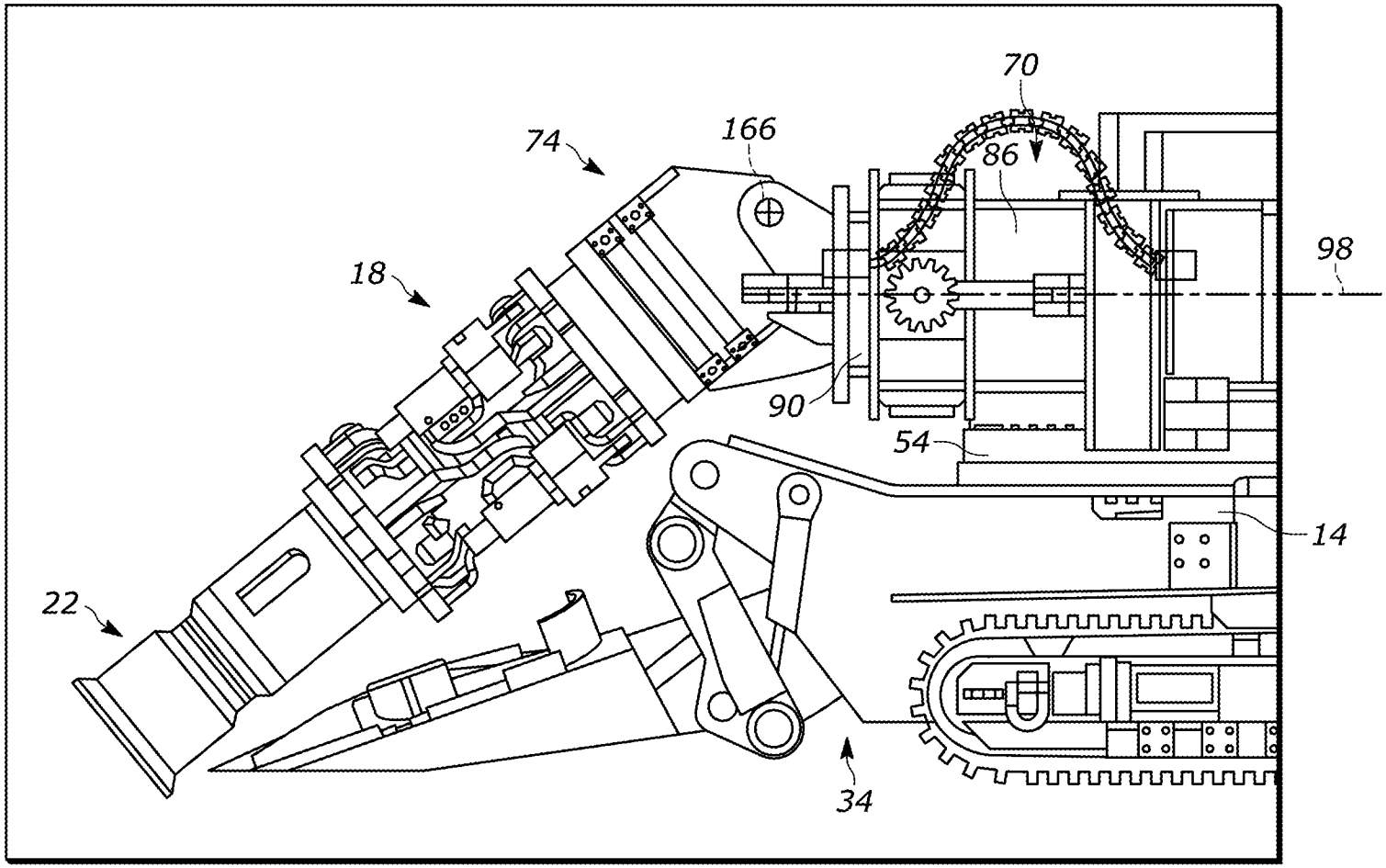
FIG. 12 is a side view of a portion of the mining machine with a boom in a lower position.
Figure 13:
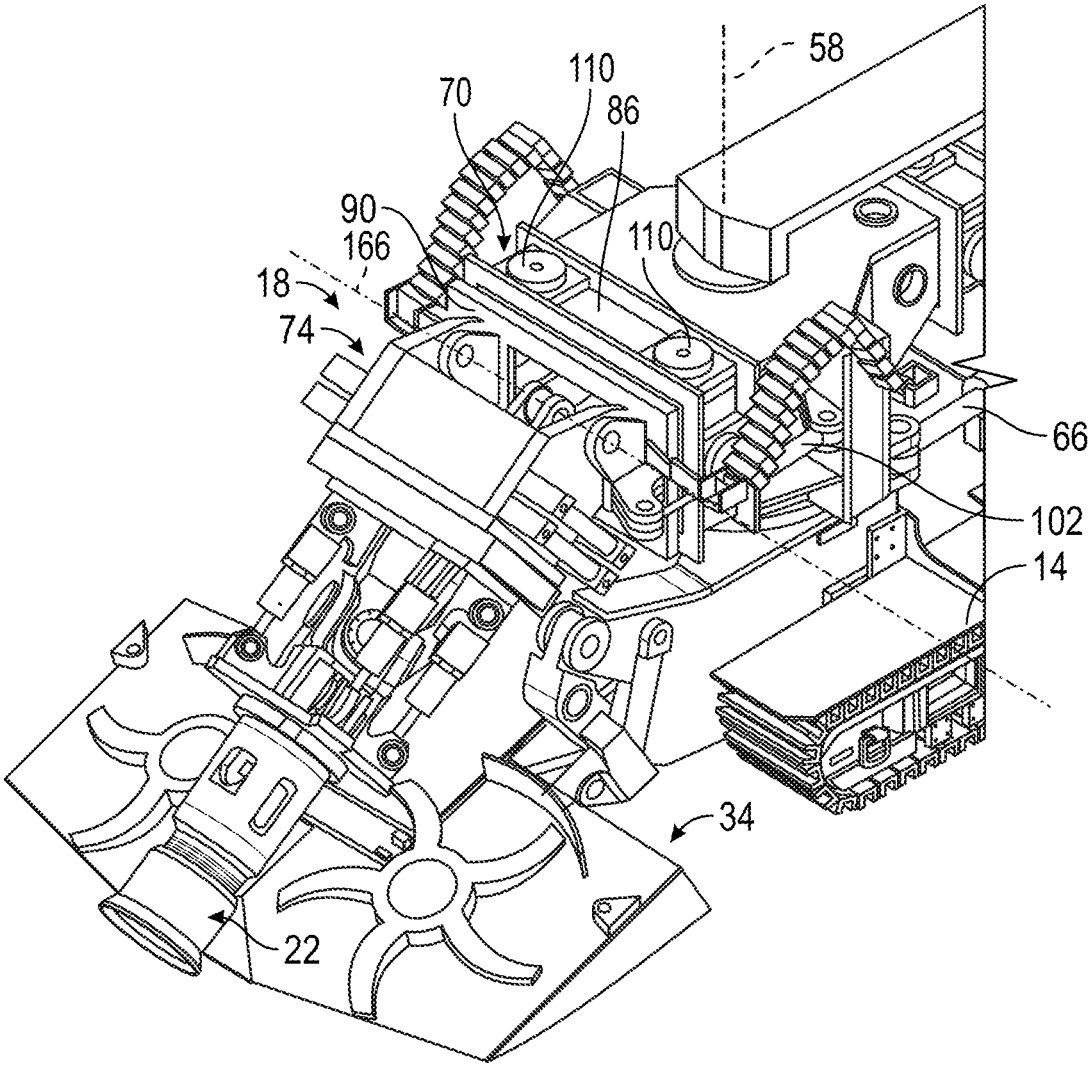
FIG. 13 is a perspective view of a portion of the mining machine of FIG. 12 with the boom in a lower position.
Figure 14:
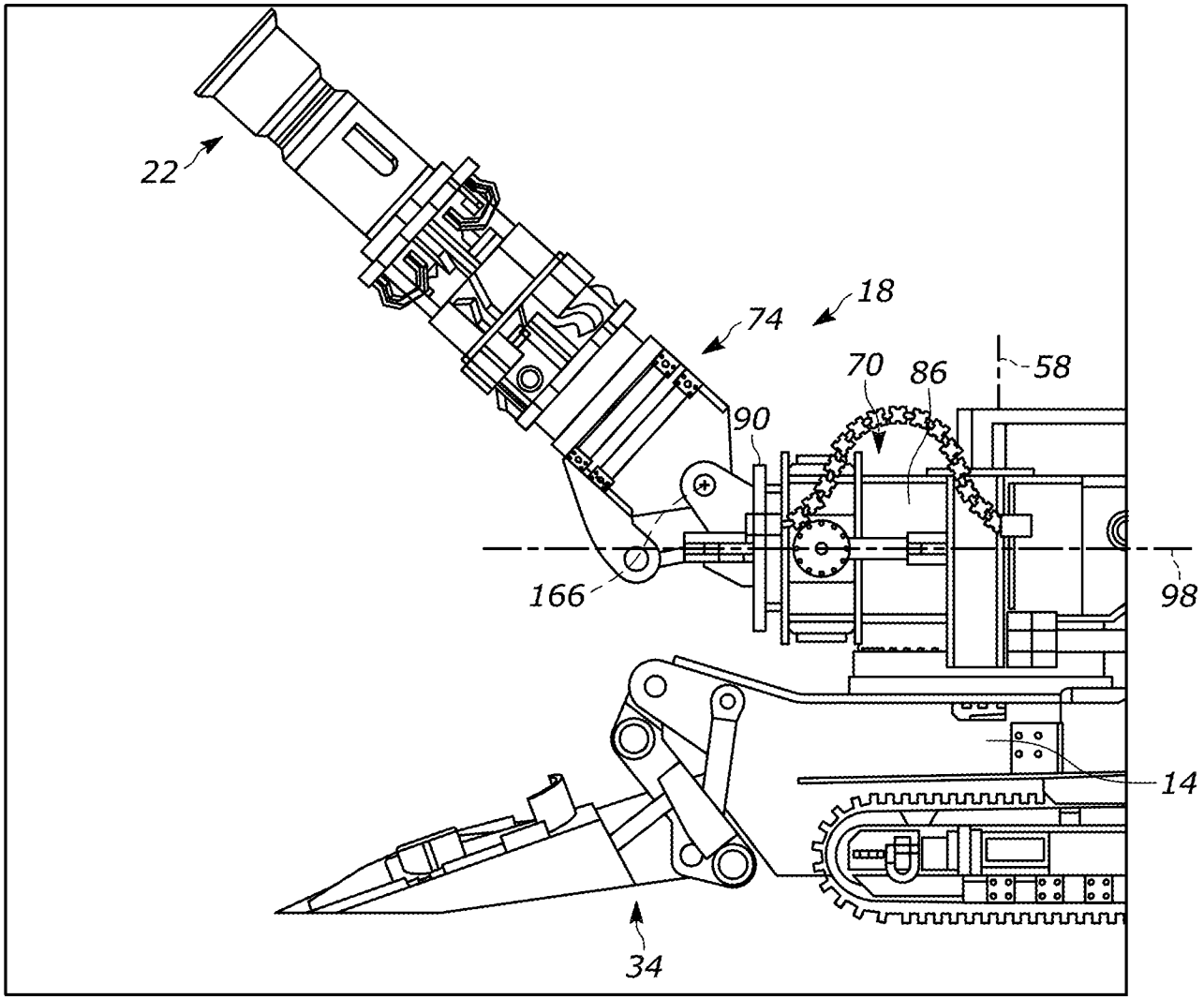
FIG. 14 is a side view of a portion of the mining machine with a boom in an upper position.
Figure 15:
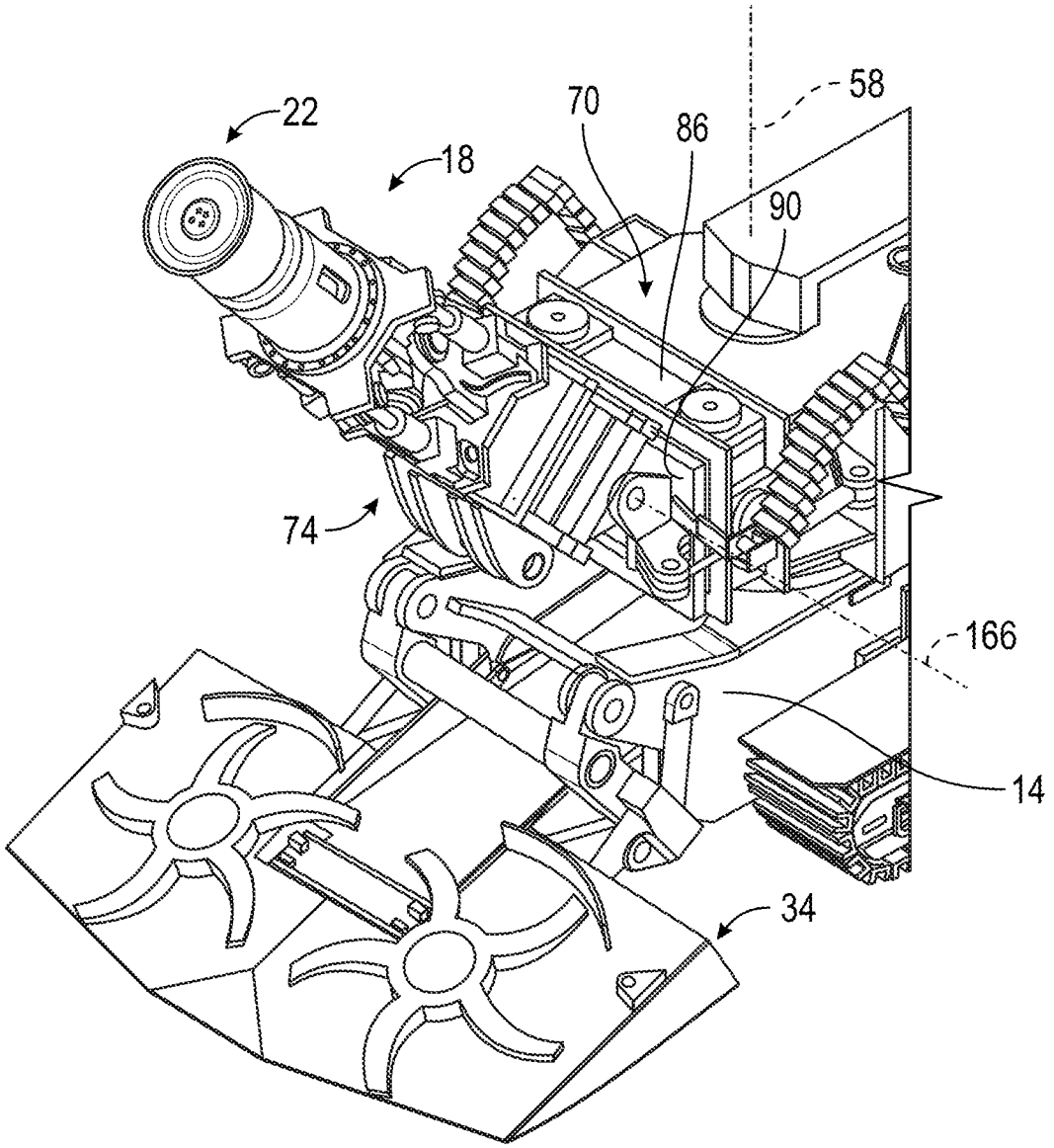
FIG. 15 is a perspective view of a portion of the mining machine of FIG. 14 with the boom in an upper position.

As shown in FIG. 11, the wrist portion 74 is pivotable relative to the base portion 70 due to operation of one or more fluid actuators (e.g., hydraulic cylinder) or luff actuators 162. In the illustrated embodiment, extension and retraction of the luff actuators 162 causes the wrist portion 74 to pivot about a transverse axis 166 that is perpendicular to the base axis 98. The wrist portion 74 may be pivoted between a first or lower position (FIGS. 12 and 13) and a second or upper position (FIGS. 14 and 15), or an intermediate position between the lower position and the upper position. Stated another way, the luff actuators 162 drive the wrist portion 74 to pivot in a plane that is parallel to the base axis 98 and the plane generally extends between an upper end of the machine 10 and a lower end of the machine 10.

In the illustrated embodiment, each luff actuator 162 includes a first end and a second end, with the first end coupled to the movable structure 90 of the base portion 70 and the second end coupled to the wrist portion 74. Each actuator 162 extends through the base portion 70 of the boom 18, such that the actuators 162 are positioned in the movable structure 90. Also, the transverse axis 166 may be offset from the base axis 98 such that the transverse axis 166 and the base axis 98 do not intersect each other. In the illustrated embodiment, the machine 10 includes two luff cylinders 162; in other embodiments, the machine 10 may include fewer or more actuators 162.

Figure 16:
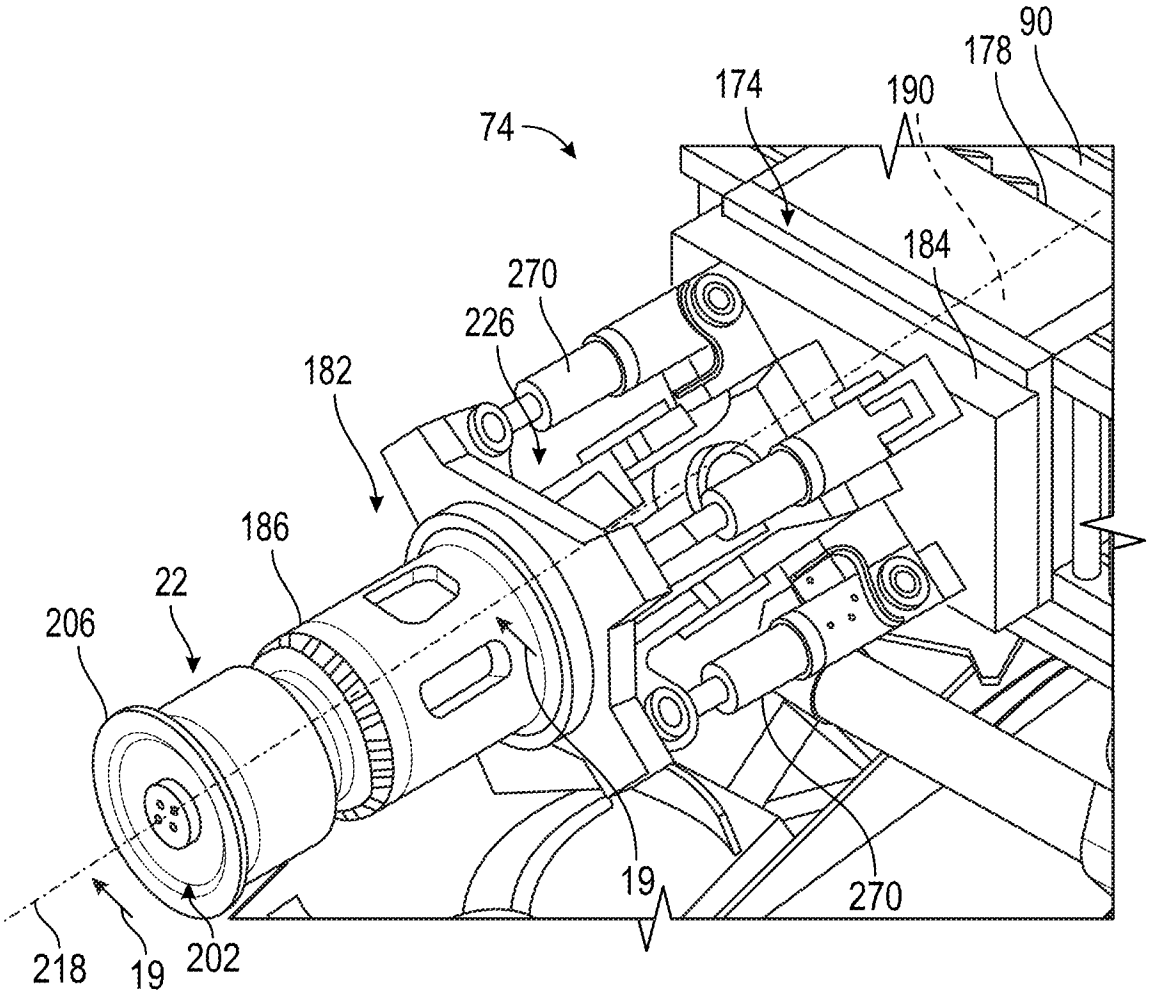
FIG. 16 is an enlarged perspective view of a cutter head.
Figure 17:
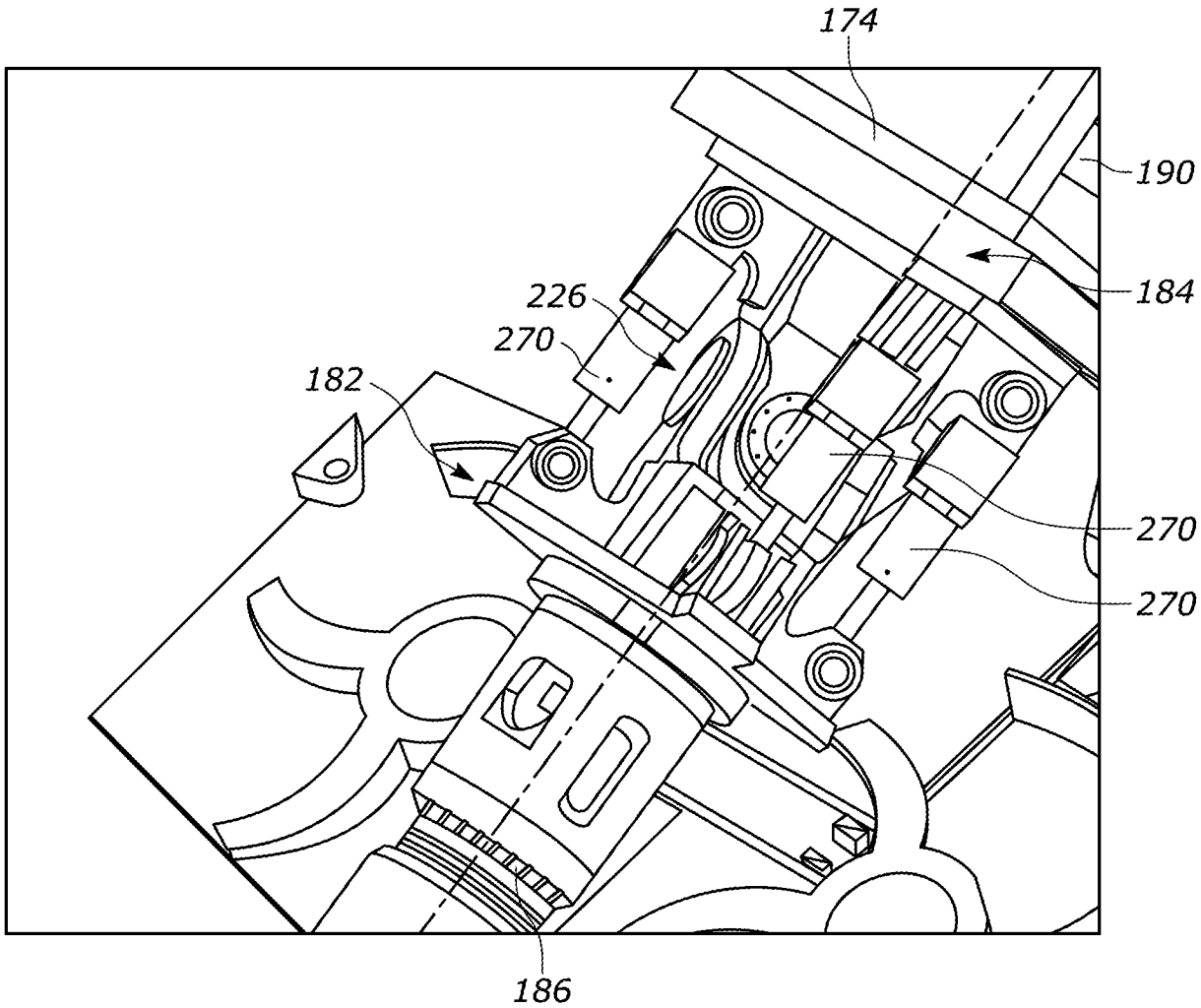
FIG. 17 is an enlarged perspective view of the cutter head of FIG. 16, with the boom in a lower position.

As shown in FIGS. 16 and 17, the wrist portion 74 includes a first member 174 proximate a first end 178 and a second member 182 proximate a second end 186, and a wrist axis 190 extends between the first end 178 and the second end 186. The first end 178 of the wrist portion 74 is coupled to the movable structure 90 of the base portion 70, and therefore the wrist portion 74 translates or telescopes with the movable structure 90 in a direction parallel to the base axis 98. The cutter head 22 (FIG. 16) is positioned adjacent the second end 186 of the wrist portion 74.

Figure 18:
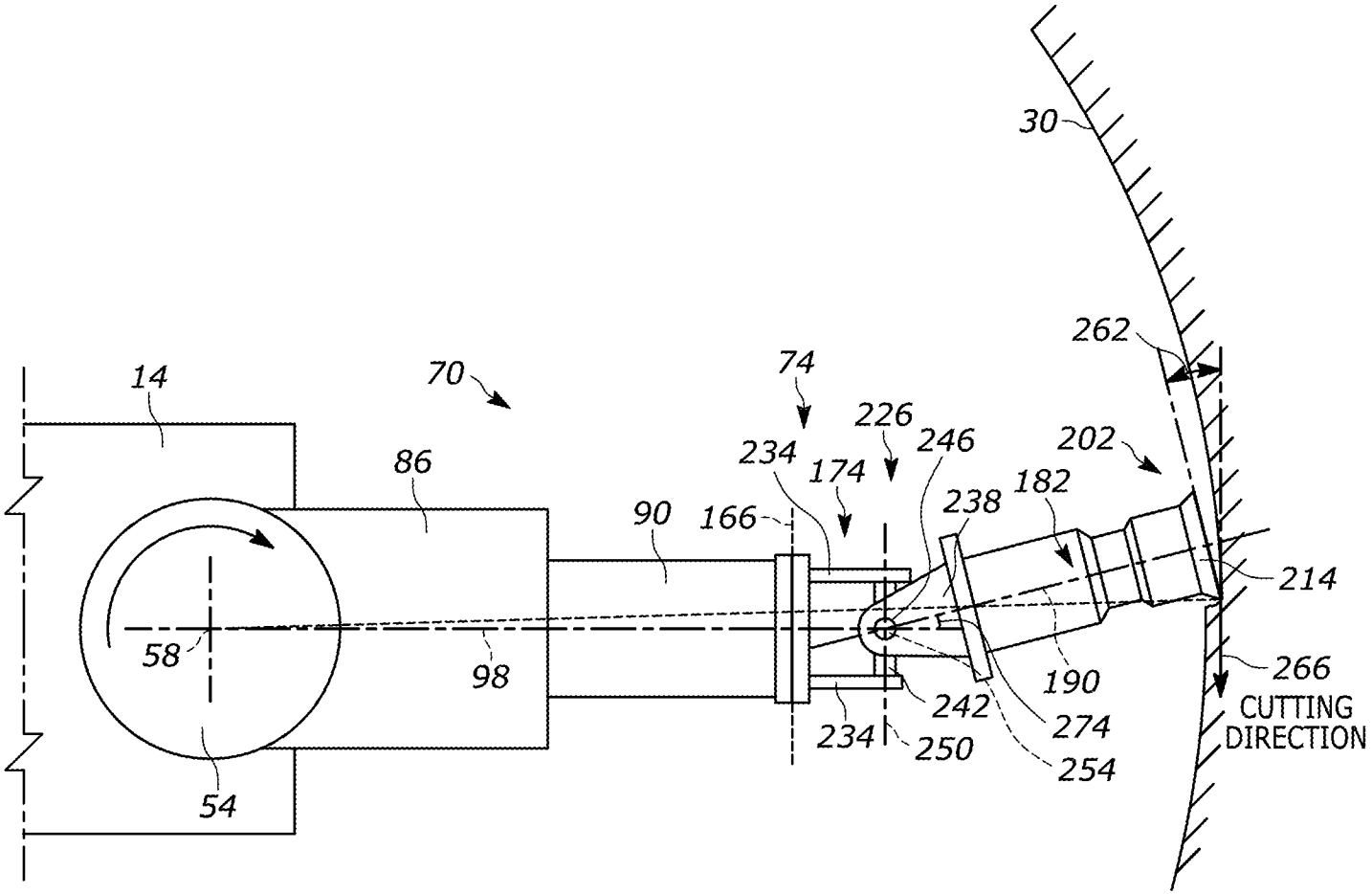
FIG. 18 is a schematic top view of a portion of the mining machine of FIG. 4, with a cutter head engaging a rock wall.

The cutter head 22 is positioned adjacent a distal end of the boom 18. As shown in FIG. 16, in the illustrated embodiment the cutter head 22 includes a cutting member or bit or cutting disc 202 having a peripheral edge 206, and a plurality of cutting bits 210 (FIG. 19) are positioned along the peripheral edge 206. The peripheral edge 206 may have a round (e.g., circular) profile, the cutting bits 210 may be positioned in a common plane defining a cutting plane 214 (FIG. 18). The cutting disc 202 may be rotatable about a cutter axis 218 that is generally perpendicular to the cutting plane 214. In the illustrated embodiment, the cutter axis 218 is aligned with the wrist axis 190 (FIG. 18).

As shown in FIG. 18, the wrist portion 74 includes a universal joint or U-joint 226 coupling the first member 174 and the second member 182. In particular, the first member 174 includes a pair of parallel first lugs 234 and the second member 182 includes a pair of parallel second lugs 238. A first shaft 242 extends between the first lugs 234 and a second shaft 246 extends between the second lugs 238 and is coupled to the first shaft 242. In some embodiments, the second shaft 246 is rigidly coupled to the first shaft 242. The first shaft 242 defines a first axis 250 that is substantially perpendicular to the wrist axis 190, and the second shaft 246 defines a second axis 254. The second axis 254 may be substantially perpendicular to the cutter axis 218 (FIG. 16). The first axis 250 and the second axis 254 are oriented perpendicular to each other. The universal joint 226 allows the second member 182 to pivot relative to the first member 174 about the first axis 250 and the second axis 254. Other aspects of universal joints are understood by a person of ordinary skill in the art and are not discussed in further detail. Among other things, the incorporation of the universal joint 226 permits the cutter head 22 to precess about the axes 250, 254 of the universal joint 226, and the joint 226 is capable of transferring shear and torque loads.

The cutter head 22 engages the rock face 30 by undercutting the rock face 30. The cutting disc 202 traverses across a length of the rock face 30 in a cutting direction 266. A leading portion of the cutting disc 202 engages the rock face 30 at a contact point and is oriented at an angle 262 relative to a tangent of the rock face 30 at the contact point. The cutting disc 202 is oriented at an acute angle 262 relative to a tangent of the rock face 30, such that a trailing portion of the cutting disc 202 (i.e., a portion of the disc 202 that is positioned behind the leading portion with respect to the cutting direction 266) is spaced apart from the face 30. The angle 262 provides clearance between the rock face 30 and a trailing portion of the cutting disc 202.

In some embodiments, the angle 262 is between approximately 0 degrees and approximately 25 degrees. In some embodiments, the angle 262 is between approximately 1 degree and approximately 10 degrees. In some embodiments, the angle 262 is between approximately 3 degrees and approximately 7 degrees. In some embodiments, the angle 262 is approximately 5 degrees.

Referring again to FIGS. 16 and 17, the wrist portion 74 further includes a suspension system for controlling movement of the second member 182 relative to the first member 174. In the illustrated embodiment, the suspension system includes multiple suspension actuators 270 (e.g., hydraulic cylinders). The suspension actuators 270 may be independently operated to maintain a desired offset angle 274 (FIG. 18) between the first member 174 and the second member 182. In addition, the suspension actuators 270 may be filled with fluid and act similar to springs to counteract the reaction forces exerted on the cutter head 22 by the rock face 30.

In the illustrated embodiment, the suspension system includes four fluid cylinders 270 spaced apart from one another about the wrist axis 190 by an angular interval of approximately 90 degrees. The cylinders 270 extend in a direction that is generally parallel to the wrist axis 190, but the cylinders 270 are positioned proximate the end of each of the first shaft 242 and the second shaft 246 of the universal joint 226. Each fluid cylinder 270 includes a first end coupled to the first member 174 and a second end coupled to the second member 182. The ends of each cylinder 270 may be connected to the first member 174 and the second member 182 by spherical couplings to permit pivoting movement. The suspension system transfers the cutting force as a moment across the universal joint 226, and controls the stiffness between the first member 174 and the second member 182.

In other embodiments, the suspension system may include fewer or more suspension actuators 270. The suspension actuators 270 may be positioned in a different configuration between the first member 174 and the second member 182. In still other embodiments, the suspension system may incorporate one or more mechanical spring element(s) either instead of or in addition to the fluid cylinders 270. Also, in some embodiments, a fluid manifold 184 (e.g., a sandwich manifold—FIGS. 16 and 17) may be positioned between the first member 174 and the universal joint 226 to provide fluid communication to the suspension actuators 270.

Figure 19:
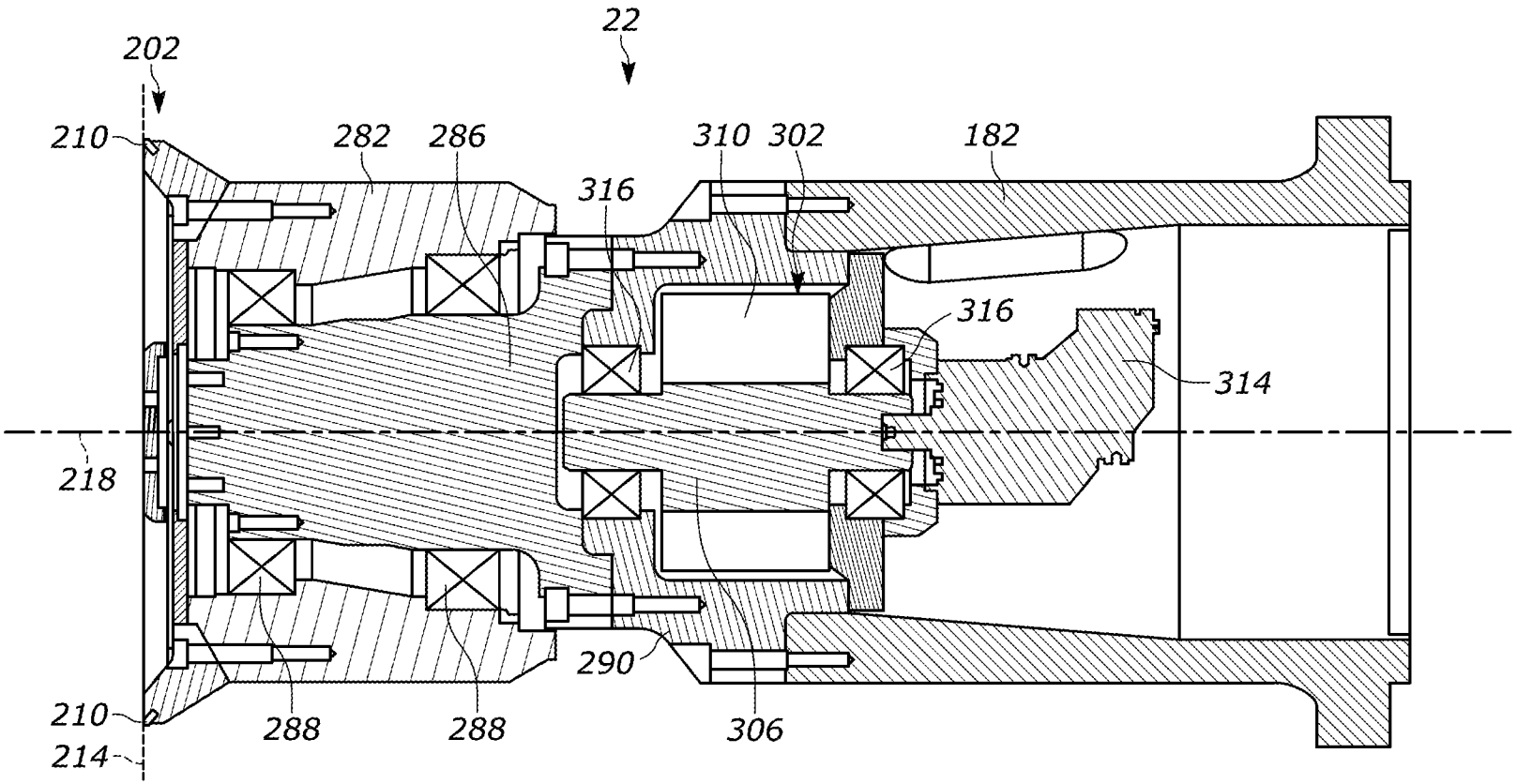
FIG. 19 is a cross-section view of the cutter head of FIG. 16, viewed along section 19-19.

As shown in FIG. 19, the cutter head 22 is positioned adjacent a second end 186 of the wrist portion 74 (FIG. 16). The cutting disc 202 is rigidly coupled to a carrier 282 that is supported on a shaft 286 for rotation (e.g., by straight or tapered roller bearings 288) about the cutter axis 218. The cutter head 22 further includes a housing 290. In the illustrated embodiment, the housing 290 is positioned between the second end 186 of the wrist portion 74 and the shaft 286, and the housing 290 is formed as a separate structure that is removably coupled to the second end 186 of the wrist portion 74 (e.g., by fasteners) and is removably coupled to the shaft 286 (e.g., by fasteners). In some embodiments, the housing 290 is formed as multiple separate sections that are coupled together.

The housing 290 supports an excitation element 302. The excitation element 302 includes an exciter shaft 306 and an eccentric mass 310 positioned on the exciter shaft 306. The exciter shaft 306 is driven by a motor 314 and is supported for rotation (e.g., by straight or tapered roller bearings 316)

relative to the housing 290. The rotation of the eccentric mass 310 induces an eccentric oscillation in the housing 290, the shaft 286, and the cutting disc 202. The excitation element 302 and cutter head 22 may be similar to the exciter member and cutting bit described in U.S. Publication No. 2014/0077578, published Mar. 20, 2014, the entire contents of which are hereby incorporated by reference. In the illustrated embodiment, the cutting disc 202 is supported for free rotation relative to the shaft 286; that is, the cutting disc 202 is neither prevented from rotating nor positively driven to rotate except by the induced oscillation caused by the excitation element 302 and/or by the reaction forces exerted on the cutting disc 202 by the rock face 30.

Figure 5:
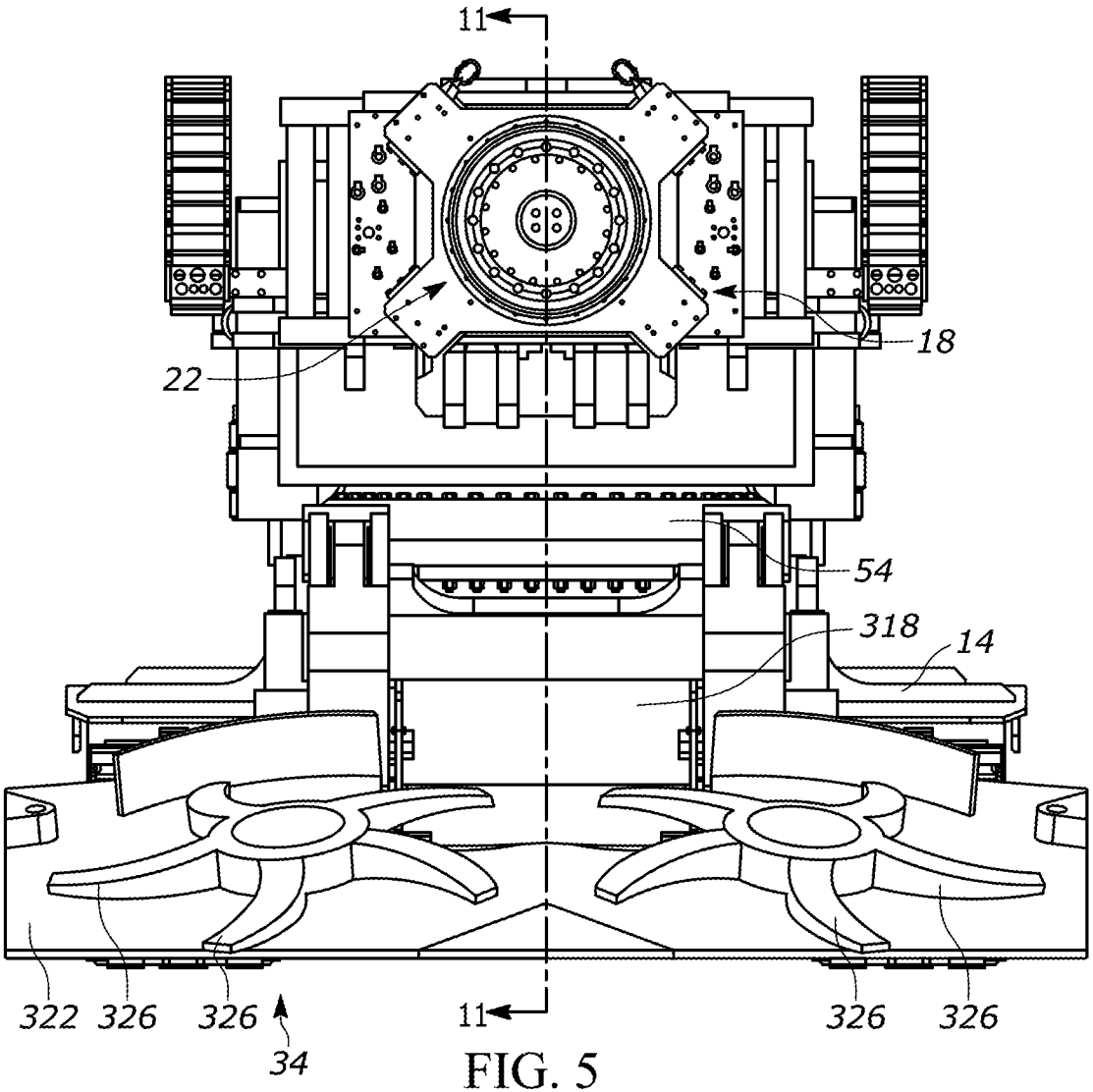
FIG. 5 is a front view of the mining machine of FIG. 1.
Figure 20:
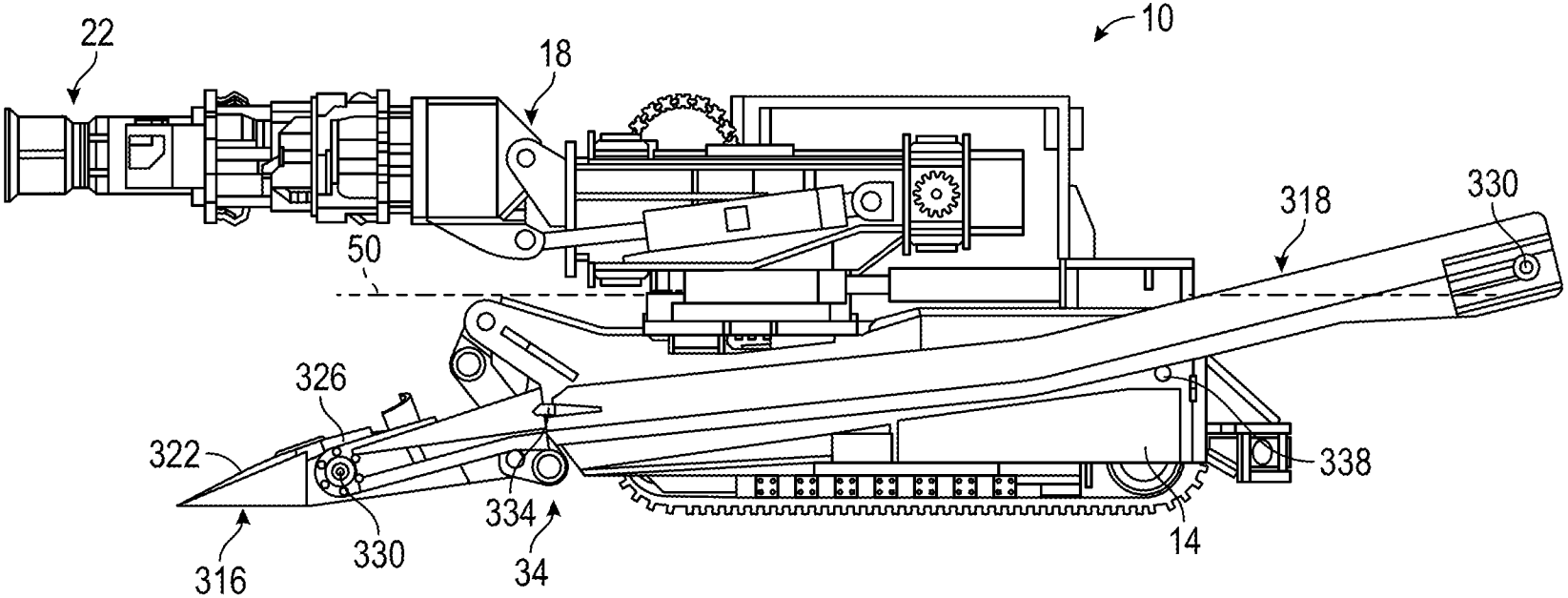
FIG. 20 is a cross-section view of the mining machine of FIG. 5, viewed along section 11-11, with the gathering head in a retracted position.
Figure 24:
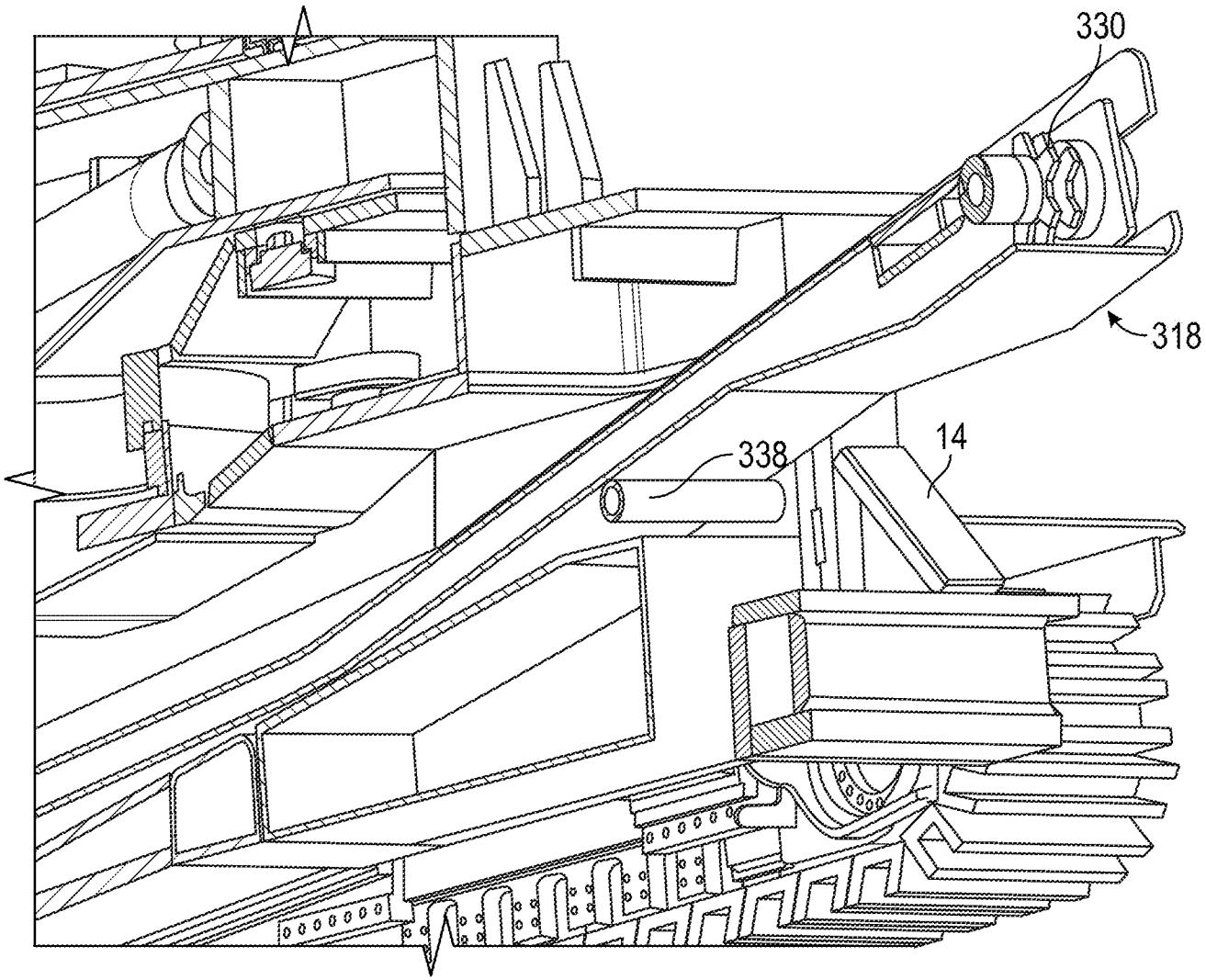
FIG. 24 is a cross-section view of a portion of the mining machine of FIG. 1.

Referring now to FIG. 20, the material handling system 34 includes a gathering head 316 and a conveyor 318. The gathering head 316 includes an apron or deck 322 and rotating arms 326 (FIG. 5). As the machine 10 advances, the cut material is urged onto the deck 322, and the rotating arms 326 move the cut material onto the conveyor 318 for transporting the material to a rear end of the machine 10. The conveyor 318 may be a chain conveyor driven by one or more sprockets 330. In the illustrated embodiment, the conveyor 318 is coupled to the gathering head 316 by a pin joint 334 and is supported for movement relative to the chassis 14 by a roller 338 (FIG. 24). In other embodiments, the arms may slide or wipe across a portion of the deck 322 (rather than rotating) to direct cut material onto the conveyor 318. Furthermore, in other embodiments, the material handling system 34 may also include a pair of articulated arms, each of which supports a bucket for removing material from an area in front of the machine 10 and directing the material onto the deck 322.

Figure 21:
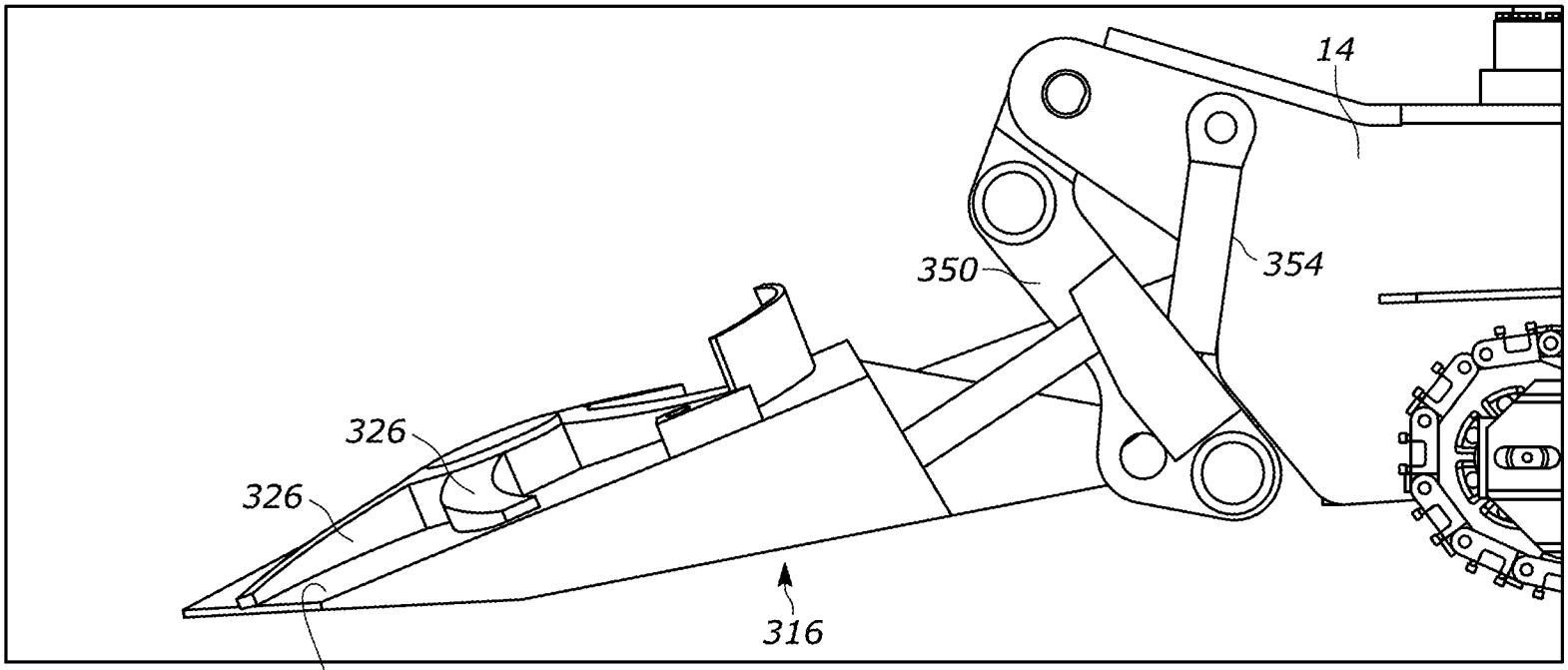
FIG. 21 is an enlarged side view of the mining machine of FIG. 2 with the gathering head in a retracted position.

As shown in FIG. 21, the gathering head 316 and the conveyor 318 are coupled together and are supported for movement relative to the chassis 14. Specifically, the gathering head 316 and conveyor 318 are coupled to the chassis 14 by a link 350 and a sumping actuator 354. Although only one link 350 and sumping actuator 354 is shown in FIG. 20, it is understood that the machine 10 may include a similar link 350 and sumping actuator 354 on each side of the machine 10.

Figure 22:
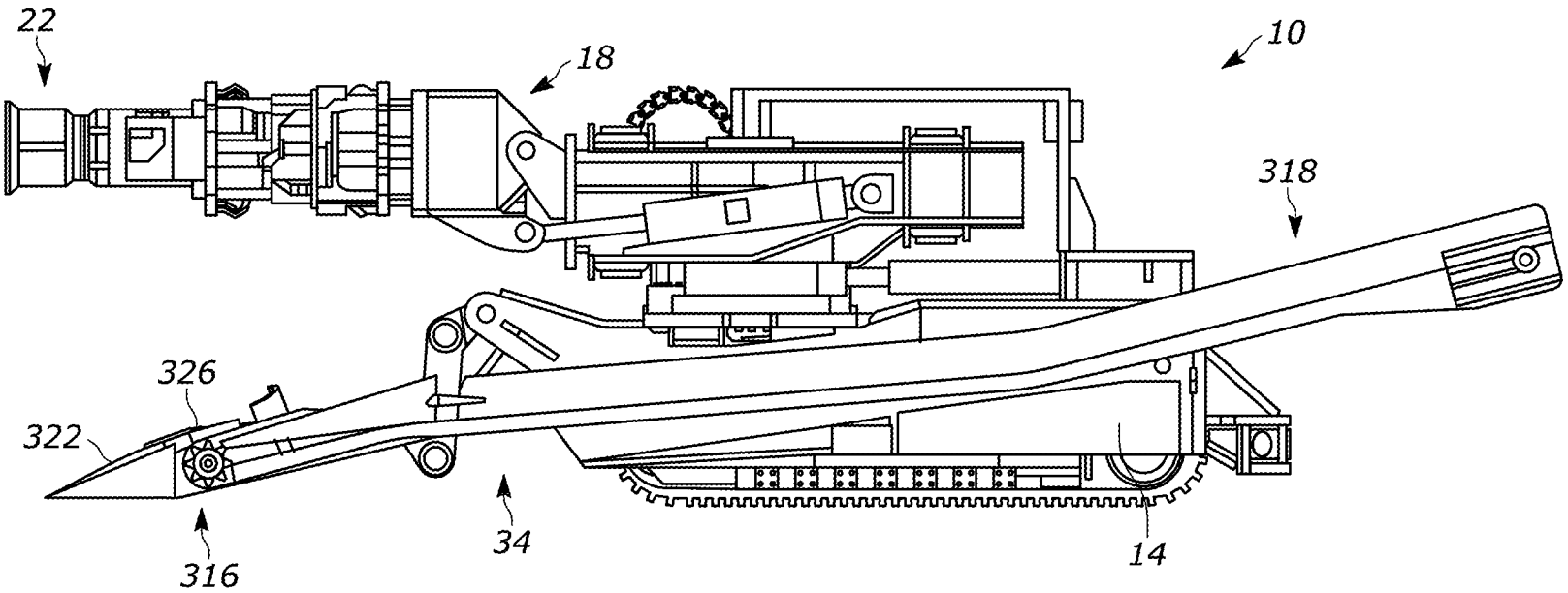
FIG. 22 is a cross-section view of the mining machine of FIG. 5, viewed along section 11-11, with the gathering head in an extended position.
Figure 23:
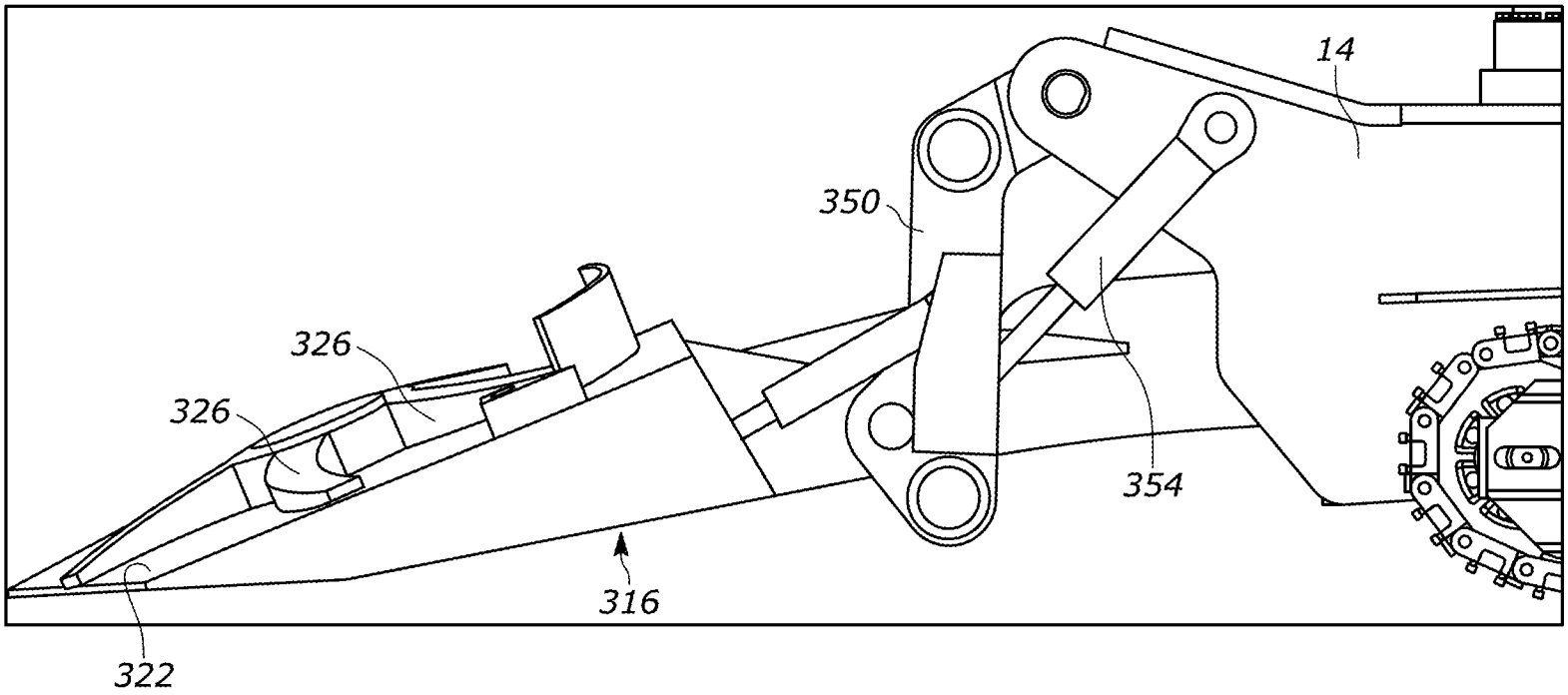
FIG. 23 is an enlarged side view of the mining machine of FIG. 2 with the gathering head in an extended position.

In the illustrated embodiment, a first end of the link 350 is pivotably coupled to the chassis 14 (e.g., proximate an upper end of the front of the chassis 14) and a second end of the link 350 is pivotable coupled to the gathering head 316. The sumping actuator 354 is coupled between the chassis 14 and the link 350 such that operation of the sumping actuator 354 moves the gathering head 316 and conveyor 318 relative to the chassis 14 (movement that is commonly referred to as "sumping"). The gathering head 316 and chassis 14 may be moved between a retracted position (FIGS. 20 and 21) and an extended position (FIGS. 22 and 23), and any intermediate position between the retracted position and the extended position. The stroke of the sumping actuators 354 may be measured with a sensor (e.g., an internal transducer—not shown). In some embodiments, the sumping actuators 354 include floating pistons to maintain the forward edge of the deck 322 against the ground.

In general, the coupling between the wrist portion 74 and the base portion 70 is positioned forward (i.e., distal) with respect to the telescoping coupling between the stationary structure 86 and the movable structure 90. As a result, the articulating portion of the boom 18 is more compact, thereby reducing the area between the cutter head 22 and the forward edge of the gathering head 316. Also, the material handling system 34 is coupled to the chassis 14 independent of the boom 18. As a result, the material handling system 34 can be extended and retracted independent of the boom 18. For example, the boom 18 may be extended relative to the chassis 14, and the material handling system 34 may be extended by a distance that is greater than, less than, or equal to the extension of the boom 18. This provides versatile control of the cutting and gathering operations. In some embodiments, the material handling system 34 can be extended and retracted through a linear distance of approximately 500 mm, and the boom 18 can be extended and retracted through a similar distance.

Although the cutter head 22 has been described above with respect to a mining machine (e.g., an entry development machine), it is understood that one or more independent aspects of the boom 18, the cutter head 22, the material handling system 34, and/or other components may be incorporated into another type of machine and/or may be supported on a boom of another type of machine. Examples of other types of machines may include (but are not limited to) drills, road headers, tunneling or boring machines, continuous mining machines, longwall mining machines, and excavators.

Although various aspects have been described in detail with reference to certain embodiments, variations and modifications exist within the scope and spirit of one or more independent aspects as described. Various features and advantages are set forth in the following claims.

What is claimed is:

1. A cutting assembly for a rock excavation machine, the rock excavation machine including a frame, the cutting assembly comprising:

a boom supported on the frame, the boom including a first portion and a second portion, the first portion including a first structure and a second structure slidable relative to the first structure, the second portion including a first member pivotably coupled to the second structure, and a second member pivotably coupled to the first member, the boom further including a first fluid actuator for pivoting the first member relative to the first portion, a second fluid actuator for driving sliding movement of the second structure relative to the first structure, and at least one biasing member coupled between the first member and the second member; and a cutting device supported on the second member, wherein the second member is pivotably coupled to the first member by a universal joint, the second portion further including a plurality of biasing members coupled between the first member and the second member.

2. The cutting assembly of claim 1, wherein the first portion is supported on a turntable to pivot laterally relative to the chassis about a pivot axis, wherein the second portion is pivotable relative to the first portion about a transverse axis oriented substantially perpendicular with respect to the pivot axis.

3. The cutting assembly of claim 1, wherein sliding movement of the second structure moving the second portion toward and away from a pivot axis of the boom.

4. The cutting assembly of claim 1, wherein the cutting device includes a cutting disc having a cutting edge positioned in a cutting plane, the cutting plane oriented in a direction substantially perpendicular to a longitudinal axis of the second portion of the boom.

5. The cutting assembly of claim 1, wherein the cutting device includes a cutting disc and an excitation device, the excitation device including an eccentric mass supported for rotation in an eccentric manner and positioned proximate the cutting disc, wherein rotation of the eccentric mass induces oscillation of the cutting device.

6. A cutting assembly for a rock excavation machine, the rock excavation machine including a frame, the cutting assembly comprising:

a boom including a first end supported on the frame and a second end, the boom including a first portion adjacent the first end and a second portion adjacent the second end, the second portion supported for movement relative to the first end by a telescopic coupling and pivotable relative to the first portion about an axis, the second portion including a first member and a second member, the first member directly coupled to the first portion, the second member pivotably coupled to the first member and positioned adjacent the second end, the boom further including at least one fluid actuator for pivoting the first member relative to the first portion, the fluid actuator positioned within the telescoping coupling, the boom further including at least one biasing member coupled between the first member and the second member; and a cutting device supported on the second end of the boom.

7. The cutting assembly of claim 6, wherein the telescopic coupling is positioned between the first end of the boom and the axis.

8. The cutting assembly of claim 6, wherein the second member supports the cutting device, the second member pivotably coupled to the first member by a universal joint and a plurality of biasing members.

9. The cutting assembly of claim 6, wherein the second portion is pivotable in a first plane between a raised position and a lowered position, wherein the first end is supported for pivoting laterally relative to the chassis in a second plane oriented perpendicular to the first plane.

10. A cutting assembly for a rock excavation machine, the rock excavation machine including a frame, the cutting assembly comprising:

a boom supported on the frame, the boom including a first portion and a second portion, the first portion including a first structure and a second structure slidable relative to the first structure, the second portion including a first member pivotably coupled to the second structure, and a second member pivotably coupled to the first member, the boom further including a first fluid actuator for pivoting the first member relative to the first portion, a second fluid actuator for driving sliding movement of the second structure relative to the first structure, and at least one biasing member coupled between the first member and the second member; and a cutting device supported on the second member, wherein the first portion is supported on a turntable to pivot laterally relative to the chassis about a pivot axis, wherein the second portion is pivotable relative to the first portion about a transverse axis oriented substantially perpendicular with respect to the pivot axis.

11. The cutting assembly of claim 10, wherein sliding movement of the second structure moving the second portion toward and away from a pivot axis of the boom.

12. The cutting assembly of claim 10, wherein the cutting device includes a cutting disc having a cutting edge positioned in a cutting plane, the cutting plane oriented in a direction substantially perpendicular to a longitudinal axis of the second portion of the boom.

13. The cutting assembly of claim 10, wherein the cutting device includes a cutting disc and an excitation device, the excitation device including an eccentric mass supported for rotation in an eccentric manner and positioned proximate the cutting disc, wherein rotation of the eccentric mass induces oscillation of the cutting device.

* * * * *